US006051083A

United States Patent [19]

Tamaki et al.

[11] Patent Number: 6,051,083

[45] **Date of Patent: *Apr. 18, 2000**

[54] HIGH STRENGTH NI-BASE SUPERALLOY FOR DIRECTIONALLY SOLIDIFIED CASTINGS

[75] Inventors: Hideki Tamaki, Hitachi; Akira Yoshinari, Hitachinaka; Akira Okayama, Hitachi; Mitsuru Kobayashi, Hitachioota; Kagehiro Kageyama, Yasugi; Takehiro Ohno, Yonago, all of Japan

[73] Assignees: Hitachi, Ltd.; Hitachi Metals, both of Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/799,017

[22] Filed: Feb. 7, 1997

[30] Foreign Application Priority Data

Feb. 9, 1996 [JP] Japan ..... 8-023639

[51] Int. Cl.[7] ..... C22C 19/00; C22C 19/05

[52] U.S. Cl. ..... 148/410; 148/404; 148/428; 148/462; 420/448

[58] Field of Search ..... 148/410, 428, 148/404, 562; 420/448; C22C 19/05

[56] References Cited

U.S. PATENT DOCUMENTS

| | | | |
|---|---|---|---|
| 3,260,505 | 7/1966 | Ver Snyder . | |
| 3,494,709 | 2/1970 | Piearcey . | |
| 4,209,348 | 6/1980 | Duhl et al. . | |
| 4,292,076 | 9/1981 | Gigliotti et al. . | |
| 4,582,548 | 4/1986 | Harris et al. . | |
| 4,643,782 | 2/1987 | Harris et al. . | |
| 4,719,080 | 1/1988 | Duhl et al. . | |
| 4,915,907 | 4/1990 | Shah et al. | 420/448 |
| 5,035,958 | 7/1991 | Jackson et al. . | |
| 5,069,873 | 12/1991 | Harris et al. . | |
| 5,173,255 | 12/1992 | Ross et al. . | |
| 5,316,866 | 5/1994 | Goldman et al. | 420/448 |
| 5,366,695 | 11/1994 | Erickson | 420/448 |
| 5,399,313 | 3/1995 | Ross et al. . | |

FOREIGN PATENT DOCUMENTS

| | | |
|---|---|---|
| 637476 | 7/1994 | European Pat. Off. . |
| 637476 | 2/1995 | European Pat. Off. . |
| 60-162757 | 8/1985 | Japan . |
| 5-59473 | 3/1993 | Japan . |
| 5-59474 | 3/1993 | Japan . |
| 7-070679 | 3/1995 | Japan . |
| 7-145703 | 6/1995 | Japan . |

OTHER PUBLICATIONS

CM186LC (Material & Process), vol. 7, 1994, p. 1797.

CM186LC (Material & Process), vol. 8, 1995, p. 1458.

*Primary Examiner*—Sikyin Ip

*Attorney, Agent, or Firm*—Beall Law Offices

[57] ABSTRACT

In order to provide a high strength Ni-base superalloy for directionally solidified castings, which is prevented from solidification cracking at the casting, having a sufficient grain boundary strength for ensuring reliability during its operation and a superior high temperature concurrently, a high strength Ni-base superalloy for directionally solidified castings having a superior grain boundary strength, which contains C: 0.05% to less than 0.1%, B: 0.015% to 0.04%, Hf: 0.01~less than 0.5%, Zr: less than 0.01%, Cr: 1.5%~16%, Mo: utmost 6%, W: 2~12%, Re: 0.1~9%, Ta: 2~12%, Nb: utmost 4%, Al: 4.5~6.5%, Ti: less than 0.5%, Co: less than 9%, and Ni: at least 60% in weight, is disclosed.

25 Claims, 5 Drawing Sheets

HIGH STRENGTH NI-BASE SUPERALLOY FOR DIRECTIONALLY SOLIDIFIED CASTINGS

BACKGROUND OF THE INVENTION

The present invention relates to a novel Ni-base superalloy to be used as a material for members of apparatus operating at a high temperature, such as a bucket and/or a stationary vane of gas turbine, especially, to a superalloy preferable as a material for members to be used at a high temperature, composed of a single crystal alloy having a superior strength at a high temperature, and also having a large scale complex shape which is difficult to manufacture with a high productionyield for conventional single crystal alloy.

A combustion temperature of gas in gas turbines have tended to increase every year with the aim of improving thermal efficiency, and accordingly, a material having a strength at a high temperature superior to conventional material is required as the material for respective members of the gas turbine operating at a high temperature. For instance, the material for the bucket and/or the stationary vane which is exposed to the severest environment among the members of gas turbine operating at a high temperature, has been shifted from conventional castings of Ni-base superalloy to columnar grained castings. Further, a single crystal material having a high temperature strength is practically used in a gas turbine for engines of aircraft. The columnar grained material and the single crystal material are kinds of so-called directionally solidified material, and both of the material are cast by a method known as a directionally solidification method. The high temperature strength of the columnar grained castings can be improved by growing crystal grains slenderly in one direction by the method disclosed in U.S. Pat. No. 3,260,505, and others, in order to decrease the number of grain boundaries perpendicular to the direction of an applied main stress to as few as possible. The high temperature strength of the single crystal castings can be improved by making the whole cast body a single crystal by the method disclosed in U.S. Pat. No. 3,494,709, and others.

In order to improve further the high temperature strength of the Ni base superalloy, a solution heat treatment for precipitating γ' phase, i.e. a precipitate strengthening phase, finely and uniformly in the superalloy is effective. That means, the Ni base superalloys are strengthened by precipitation of the γ' phase composed of mainly $Ni_3$(Al, Ti, Nb, Ta), and the γ' phase is desirably precipitated finely and uniformly. However, when the superalloy is in a solidified condition without any treatment, coarse γ' phases (a γ' phase which was precipitated and grown during a cooling period after the solidification and eutectic γ' phases which were formed coarsely at a final solidified portion) exist. Therefore, the high temperature strength of the superalloy can be improved by the steps of heating the superalloy to dissolve the γ' phase into the base γ phase, then cooling rapidly (a solution heat treatment), and precipitating fine and uniform γ' phase during subsequent aging heat treatment. The solution heat treatment is desirably performed at a temperature exceeding the solves temperature of the γ' phase, and at as high a temperature as possible below the incipient melting temperature of the alloy; because the higher the heat treatment temperature is, the wider the region of fine and uniform γ' phase becomes.

Further, the wider the region of fine and uniform γ' phase is, the more the high temperature strength of the superalloy is improved. Another reason of the superior high temperature strength of the single crystal castings is that the temperature for the solution heat treatment can be increased by using an alloy exclusively for forming a single crystal, containing chemical elements for grain boundary strength which lower significantly the incipient melting temperature of the alloy by a very small amount such as an impurity level, and consequently, almost all the γ' phase precipitated coarsely after the solidification can be made fine and uniform.

As explained above, the single crystal castings of the Ni base superalloy is the most superior material for the material of bucket and/or stationary vane of gas turbines in conventional technology. Therefore, single crystal alloys such as CMSX-4 (U.S. Pat. No. 4,643,782), PWA1482 (U.S. Pat. No. 4,719,080), Rene' N5 (JP-A-5-59474 (1993)), and others have been developed, and used practically as the material for a bucket and/or a stationary vane of gas turbines of aircraft engines. However, as explained above, these single crystal alloys contains chemical elements such as C, B, Hf, and the like for grain boundary strength by only an impurity level. Accordingly, if any grain boundary exists in the bucket and/or the stationary vane cast from the single crystal alloy, the strength of the bucket and/or the stationary vane decreases extremely, and in some cases, a vertical crack is generated in the bucket and/or the stationary vane along the grain boundary during the solidification step. Therefore, when the bucket and/or the stationary vane cast from the single crystal alloy is used for the gas turbine, the whole bucket and/or the stationary vane should be a complete single crystal. Because the bucket and/or the stationary vane of the gas turbine for aircraft is approximately 100 mm long at the maximum, the probability to generate a grain boundary during the casting is small, and the bucket and/or the stationary vane of single crystal alloy can be produced with a reasonable production yield. However, as the bucket and/or the stationary vane of the gas turbine for power generation is approximately 150~450 mm long, it is very difficult to produce the whole bucket and/or the stationary vane with a complete single crystal. Accordingly, with the conventional technology, it is difficult to produce the bucket and/or the stationary vane of the gas turbine for power generation using the conventional single crystal alloy with a reasonable production yield.

In order to improve the strength at a high temperature of large size bucket and/or stationary vane, for which the single crystal alloy can not be applied in view of a low production yield at the casting process, development of alloys for columnar grained castings having a preferable strength at a high temperature was performed, and as the result, the Ni base superalloys for columnar grained castings such as CM186LC (U.S. Pat. No. 5,069,873), Rene' 142 (U.S. Pat. No. 5,173,255) were developed. These alloys have a sufficient amount of chemical elements for preventing generation of solidification cracks, and ensuring a sufficient reliability during operating time, and concurrently, have a high temperature strength comparable to the single crystal alloys of the first generation such as PWA1480 (U.S. Pat. No. 4,209,348), CMSX-2 (U.S. Pat. No. 4,582,548), Rene' N4 (U.S. Pat. No. 5,399,313), and the like. Therefore, it became possible to produce the bucket and/or the stationary vane having approximately the same strength as the bucket and/or the stationary vane made of the first generation single crystal alloy at a high temperature with a reasonable production yield by using these alloys for columnar grained castings. However, currently, the strength at a high temperature of these conventional alloys for columnar grained castings has become insufficient for satisfying a requirement to improve further a thermal efficiency of gas turbines, because a combustion temperature of gas turbines has been in a tendency to increase further.

The single crystal alloys having columnar grains containing C, B, Zr, and Hf are disclosed in JP-A-7-145,703 (1995) and JP-A-5-59,473 (1993).

In view of the above described aspect of the prior art, development of an alloy, wherein a high production yield and a high strength at a high temperature, which are conventionally deemed as contradictive, are compatible with each other is regarded as indispensable for improving the efficiency of the gas turbines for power generation.

As previously described, a method to make the heating temperature in the solution heat treatment as high as possible is effective for improving the high temperature strength of the Ni base superalloy, and the additive amount of the chemical elements for grain boundary strength is preferably as small as an impurity level therefor. On the other hand, in order to ensure a high production yield and a high reliability during operating time, the chemical elements for grain boundary strength to give an appropriate strength to the grain boundary should be contained in the superalloy. Therefore, conventionally, the strength at the grain boundary had to be sacrificed in order to improve the high temperature strength, and on the contrary, the high temperature strength had to be sacrificed in order to improve the strength at the grain boundary.

In accordance with the study performed by the present inventors on the conventional alloys for columnar grained casting, i.e. CM186LC (Material and Process Vol. 7 (1994), p1797, and ibid Vol. 8 (1995), p1458), it has been revealed that B, one of the chemical elements for the grain boundary strength, diffuses from the grain boundary into inside grain during the solution heat treatment. Accordingly, although the alloy contains the chemical elements for grain boundary strength, the strength at the grain boundary of the alloy decreases to a level which makes the alloy unusable for practical use, if the solution heat treatment is performed for improving the high temperature strength. The high temperature strength of the directionally solidified castings is evaluated as the strength in the solidified direction, because the direction wherein the main stress is applied is generally along the solidified direction. In this case, the high temperature strength, that is a strength in the solidified direction parallel to the grain boundary, improves in accordance with increasing solution of the γ' phase. On the contrary, the grain boundary strength, that is a strength perpendicular to the grain boundary, and to the solidified direction, is decreased.

In accordance with the above findings, it is revealed that a simple addition of the chemical elements for grain boundary strength to the conventional single crystal alloy can be expected to improve the production yield of the products, but can not be expected to achieve a superior high temperature strength because the heating temperature for the solution heat treatment is decreased significantly. Regarding the conventional columnar grained alloys, the heating temperature for the solution heat treatment can not be increased further in view of problems of the incipient melting and decrease of grain boundary strength, and improving the high temperature strength more than the present status can not be expected.

SUMMARY OF THE INVENTION

The object of the present invention is to provide a high strength Ni base superalloy for directionally solidified castings, which prevents solidification cracks at the casting, having a sufficient grain boundary strength for ensuring reliability during operating time, and concurrently having a high temperature strength superior to the conventional alloy for columnar grained casting.

The present invention has been achieved as the result of studying a relationship among the additive amount of chemical elements for grain boundary strength, the high temperature strength, the grain boundary strength, and the effect of the solution heat treatment by adding various combination of the four chemical elements for grain boundary strength, that is C, B, Hf, and Zr, to the single crystal alloy, aiming at obtaining an alloy composition which makes the high temperature strength and the grain boundary strength, which are conventionally deemed as contradictive, are compatible each other.

In accordance with the study, directionally solidified columnar grained slabs having the objective composition were cast after adding the chemical elements for grain boundary strength to equiaxed grain master ingot, of which composition was adjusted to the composition of the single crystal alloy, in an unidirectionally solidifying furnace. The high temperature strength of specimen having the respective of various composition was evaluated by a creep rupture strength in the solidified direction. The casting ability and the grain boundary strength for ensuring reliability during the operating time were evaluated by a creep rupture strength and tensile strength at high temperature in a direction perpendicular to the solidified direction of the slab, that is a direction wherein the grain boundary was perpendicular to the stress applied direction.

As the result, an existence of novel optimum additive amount of B, which makes the strengths in the solidified direction and in the direction perpendicular to the solidified direction, that is, the high temperature strength and the grain boundary strength of the alloy compatible, was found at a fairly higher region than the conventionally known optimum additive amount of B. It was revealed that , when 0.03~0.20%, desirably 0.05~less than 0.1% C, utmost 1.5%, desirably less than 0.5% Hf, and utmost 0.02%, desirably less than 0.01% Zr were contained as the chemical elements for strengthening grain boundaries, the optimum additive amount of B, which was effective for both the strengths in the solidified direction and in the perpendicular direction to the solidified direction, was in the range of 0.0004~0.05%, desirably exceeding 0.015% to 0.04%, and especially, addition of approximately 0.03% B gave the maximum values for both the strengths in the solidified direction and in the perpendicular direction to the solidified direction. In comparison with conventional additive amount of B to the alloy for columnar grained casting such as approximately 0.015%, the additive amount of B disclosed in the present invention is desirably almost two times.

Boron (B) is a chemical element which decreases the incipient melting temperature of the alloy significantly. Therefore, when a large amount of B is added, decrease in the incipient melting temperature of the alloy must be considered. However, in accordance with the present invention, no significant decrease in the incipient melting temperature was observed with an alloy composition which contained almost two times B in comparison with the conventional alloy.

Carbon (C) is also an important chemical element for making the high temperature strength and the grain boundary strength compatible. It was revealed that an alloy containing 0.007~0.015% B, less than 0.5% Hf, and less than 0.01% Zr as the chemical elements for grain boundary strength decreases its creep rupture strength in the solidified direction according as the additive amount of C increases. On the contrary, the creep rupture strength in the direction perpendicular to the solidified direction increases according to increasing the additive amount of C until 0.20%, desirably 0.10%, and decreases according to increasing the additive amount of C exceeding 0.10% with a peak at 0.10%. Accordingly, if only the creep rupture strength in a direction perpendicular to the solidified direction is considered, the optimum additive amount of C exists at approximately 0.1%. On the other hand, the optimum additive amount of C for making the high temperature strength and the grain boundary strength compatible is in the range of 0.05~less than 0.1% in consideration that the creep rupture strength in the solidified direction decreases according as the additive amount of C increases. When the additive amount of C in the alloy is less than 0.05%, desirably less than 0.03%, the alloy has a superior high temperature strength, but the grain boundary strength becomes low, and solidification cracks at casting can not be prevented and reliability during operating time can not be ensured. On the other hand, when the additive amount of C in the alloy is at least 0.2%, desirably at least 0.1%, the high temperature strength decreases significantly, and also the grain boundary strength also decreases.

Zirconium (Zr) and hafnium (Hf) are chemical elements in a same group, and an effect of respective Zr and Hf to the Ni base alloy is approximately same. In accordance with the study relating to the present invention, it was revealed that Zr decreases the creep rupture strength in the solidified direction of the alloy by decreasing significantly the incipient melting temperature of the alloy to make the solution heat treatment at a high temperature impossible. Furthermore, it was revealed that Zr is ineffective to the creep rupture strength in a transverse direction. Therefore, it is necessary to designate the additive amount of Zr as desirably less than 0.01%, and preferably as substantially nil. Hf also decreases the creep rupture strength in the solidified direction of the alloy by decreasing significantly the incipient melting temperature of the alloy to make the solution heat treatment at a high temperature impossible. Furthermore, Zr is scarcely effective to the creep rupture strength in a transverse direction. However, Hf has an effect to improve tensile ductility in the transverse direction. Furthermore, it was revealed that an addition of Hf by the amount of approximately 0.25% improves both the creep rupture strength in the direction perpendicular to the solidified direction and the tensile strength, although the creep rupture strength in the solidified direction is decreased slightly. Accordingly, the additive amount of Hf is desirably in the range of 0.01~less than 0.5% , and preferably in the range of 0.2~0.4%. Furthermore, the optimum additive amount of Hf for making the high temperature strength and the grain boundary strength compatible is in the range of 0.2~0.3%.

In accordance with the alloy of the present invention, it becomes possible to make the high temperature strength and the grain boundary strength compatible, which has been impossible by the prior art, by containing the chemical elements for obtaining sufficient grain boundary strength in the alloy, and making it possible to perform sufficient solution heat treatment for improving the high temperature strength, which have been achieved by optimizing the combination of additive amounts of B, C, Hf, and Zr as explained above.

The above described result is not decided only by the combination of the chemical elements for grain boundary strength, but effects of chemical elements which contribute to strengthen inside the crystal grain can not be neglected. One of such chemical elements is cobalt (Co). The additive amount of Co is a feature of the alloy composition other than the chemical elements for the grain boundary strength in the present invention. Most of the conventional alloys for columnar grained castings contain a large amount of Co, such as more than 9%. However, in accordance with the study of the present invention, it was revealed that an addition of a large amount of Co decreases significantly the high temperatures strength of the alloy, and the addition is ineffective to the grain boundary strength. On the other hand, Co has an effect to improve corrosion resistance in combustion gas atmosphere. Therefore, Co is added as an indispensable materials for bucket and/or stationary vanes of gas turbine for power generation, of which corrosion resistance is regarded as important, in an extent not to decrease significantly the high temperature strength.

In accordance with the alloy of the present invention, one of the important reason to improve the high temperature strength by solution heat treatment without decreasing the grain boundary strength is in optimization of the additive amount of tantalum (Ta).

When the solution heat treatment is performed on the conventional alloys for columnar grained casting, such as CM186LC, for improving the high temperature strength, B is diffused from the grain boundary into inside crystal grain, and the grain boundary strength is decreased extremely. Because, when γ' phase is once dissolved into γ phase during the solution heat treatment, B starts to diffuse into the γ phase concurrently with dissolving the γ' phase near the grain boundary into the γ phase, and finally B is diminished from the grain boundary. In order to solve the above problem, a remarkably larger amount of Ta than the conventional alloy was added to the alloy of the present invention. As the result, the solves temperature of the γ' phase near the grain boundary was elevated significantly higher than that of inside the grain, and consequently, it became possible to dissolve the γ' phase inside the grain without dissolving the γ' phase near the grain boundary into the γ phase. Accordingly, the strength inside the grain of the alloy of the present invention can be increased without losing B from the grain boundary by diffusion. Consequently, it becomes possible to increase the high temperature strength without decreasing the grain boundary strength.

Generally speaking, when a solution fraction, which is a fraction of region wherein the γ' phase is precipitated finely in the alloy, increases, the more the high temperature strength is improved. However, in consideration of the grain boundary strength, the solution fraction is desirably small as possible. In order to make the high temperature strength and the grain boundary strength of the alloy compatible each other, an alloy composition is desirable, whereby the superior high temperature strength can be obtained even if the solution fraction is small. Therefore, in accordance with the alloy of the present invention, additive amounts of rhenium (Re) and tungsten (W), which are effective for strengthening by dissolving as solid solution, have been optimized for obtaining the maximum strength of the alloy by solid solution strengthening, and consequently, it becomes possible to improve the high temperature strength of the alloy with the relatively low solution fraction.

The alloy of the present invention is preferable for being used in directional solidification by an unidirectional solidifying method. Especially, in casting a bucket and/or a stationary vane of gas turbines, the casting is preferably performed with unidirectional solidification along a direction whereto the centrifugal force is applied. Hitherto, use of the alloy of the present invention has been explained mainly with an assumption that the alloy is used for the bucket and/or the stationary vane of gas turbines. However, the alloy of the present invention can be used for other members used at a high temperature such as stationary vanes and others. In a case of the stationary vanes of gas turbines, the casting is preferably performed with unidirectional solidification along a direction whereto the maximum thermal stress is applied. The alloy of the present invention can naturally be used for ordinary columnar grained buckets and/or stationary vanes, and further, can be used for a bucket and/or a stationary vane wherein grain boundaries are partly generated during the single crystal casting. The bucket and/or the stationary vane, wherein grain boundaries are partly generated, has been regarded conventionally as a defect product. However, if the alloy of the present invention is used, such a defect bucket and/or a defect stationary vane as above can be used sufficiently, and as a result, the casting yield of the single crystal bucket and/or the single crystal stationary vane can be improved significantly. Furthermore, the alloy of the present invention can be used for the ordinary single crystal bucket and/or the ordinary single crystal stationary vane. Even if the single crystal bucket and/or the single crystal stationary vane can be cast with the conventional single crystal alloy with a high production yield, use of the alloy of the present invention can reduce the production cost remarkably, because an examination for judging whether the grain boundaries exist or not can be simplified significantly. Furthermore, non-existence of the grain boundaries in the bucket and/or the stationary vane has been guaranteed conventionally by a destructive sampling test. However, strength of the alloy of the present invention can be guaranteed even if the grain boundaries exist, and reliability of the bucket and/or the stationary vane can be improved significantly.

As explained above, the present invention is on a high strength Ni-base superalloy for directionally solidified castings superior in a grain boundary strength containing preferably C: 0.03~0.20%, desirably 0.05% to less than 0.1%, B: 0.004~0.05%, desirably more than 0.015% to 0.04%, Hf: utmost 1.5%, desirably 0.01~less than 0.5%, Zr: utmost 0.02%, desirably less than 0.01%, Cr: 1.5%~16%, Mo: utmost 6%, W: 2~12%, Re: 0.1~9%, Ta: 2~12%, Nb: 0.3~4%, Al: 4.0~6.5%, Ti: less than 0.4%, desirably not added, Co: utmost 9%, and Ni: at least 60% in weight, respectively. Especially, an alloy, which makes a high temperature strength and a high strength at grain boundaries compatible and indicates a preferable corrosion resistance in combustion gas atmosphere, is a high strength Ni-base superalloy for directionally solidified castings superior in the grain boundary strength containing C: 0.06~0.10%, B: 0.018~0.04%, Hf: 0.01~less than 0.5%,Zr: less than 0.01%, Cr: 4~12.5%, Mo: utmost 4.5%, W: 5~10%, Re: 1~6%, Ta: 5~12%, Nb: 0.3~3%, Al: 4.0~6.0%, Co: 0.5~1.2% in weight, respectively, and Ni plus incidental impurities: balance. When an alloy having further superior in the high temperature strength is required, a high strength Ni-base superalloy for directionally solidified castings superior in the grain boundary strength containing C: 0.06~0.10%, B: 0.018~0.035%, Hf: 0.1~0.5%, Cr: 6.5~8.5%, Mo: 0.4~3.0%, W: 5.5~9.5%, Re: 1.0~6.0%, Ta: 6~10.5%, Nb: 0.3~1.55%, Al: 4.0~6.0%, Co: 0.5~2.5% in weight, respectively, and Ni plus incidental impurities: balance, is adequate. Further preferable composition is C: 0.06~0.10%, B: 0.018~0.035%, Hf: 0.2~0.3%, Cr: 6.9~7.3%, Mo: 0.7~2.0%, W: 7.0~9.0%, Re: 1.2~2.0%, Ta: 8.5~9.5%, Nb: 0.6~1%, Al: 4.0~6.0%, Co: 0.5~1.2% and Ni: utmost 60% in weight, respectively, or desirably, Ni plus incidental impurities: balance.

In an environment wherein fuel contains a large amount of impurities such as S and others, a high strength Ni-base superalloy for directionally solidified castings superior in the grain boundary strength containing C: 0.06~0.08%, B: 0.018~0.035%, Hf: 0.2~0.3%, Cr: 6.9~7.3%, Mo: 0.7~1%, W: 8~9%, Re: 1.2~1.6%, Ta: 8.5~9.5%, Nb: 0.3~1%, Ti: less than 0.5%, Al: 4.9~5.2%, Co: 0.8~1.2% in weight, respectively, and Ni plus incidental impurities: balance, is adequate.

In accordance with using the Ni-base superalloy having the above composition, directionally solidified castings superior in both the high temperature strength and the grain boundaries strength, having a creep rupture life in the solidified direction of more than 350 hours under the condition at 1040° C. with 14 kgf/mm$^2$, and a creep rupture life in the direction perpendicular to the solidified direction of more than 30 hours under the condition at 927° C. with 32 kgf/mm$^2$, can be obtained.

In accordance with the Ni-base superalloy having the above composition, directionally solidified castings superior in both the high temperature strength and the grain boundaries strength, which is capable of arranging γ' phases into shapes of rectangular parallelepiped having an edge equal to or less than 0.5 μm in a region at least 50% in volumetric fraction by a solution heat treatment, having a creep rupture life in the direction perpendicular to the solidified direction of more than 30 hours under the condition at 927° C., with 32 kgf/mm$^2$, and a tensile strength in the solidified direction of more than 95 kgf/mm$^2$ under the condition at 800° C. can be obtained.

The present invention is on a high strength Ni-base superalloy for directionally solidified castings containing C: 0.03~0.20%, B: 0.004~0.05%, Cr: 4.0%~12.5%, Mo: utmost 4.5%, W: 5.0~10.0%, Re: 1.0~7.0%, Ta: 5.0~12.0%, Nb: 0.3~4.0%, Al: 4.0~6.5%, Ti: less than 0.4%, Co: 0.5~5.0%, Hf: utmost 1.5%, Zr: utmost 0.15%, and Ni: at least 60% in weight, respectively, and the C content is at least a value obtained by subtracting 5.45 times of the above B content from 0.15.

Especially, respective of the C content and the B content is a value less than a straight line connecting (0.20%, 0.03%) and (0.08%, 0.05%), and desirably a value less than a straight line connecting (0.20%, 0.01%) and (0%, 0.047%).

The present invention is on a Ni-base superalloy for columnar grained casting having a creep rupture life in the solidified direction of more than 350 hours under the condition at 1040° C. with 14 kgf/mm$^2$, and a creep rupture life in the direction perpendicular to the solidified direction of more than 30 hours under the condition at 920° C. with 32 kgf/mm$^2$. Especially, the creep rupture life in the solidified direction of more than 500 hours and the creep rupture life in the direction perpendicular to the solidified direction of more than 45 hours are desirable.

The present invention is on a Ni-base superalloy for columnar grained casting having a creep rupture life in the solidified direction of more than 350 hours under the condition at 1040° C. with 14 kgf/mm$^2$, and a creep rupture life in the direction perpendicular to the solidified direction under the condition at 920° C. with 32 kgf/mm$^2$ of at least a value calculated by subtracting 32.5 from 1.5 times of the above creep rupture life in the solidified direction. Especially, the creep rupture life in the solidified direction of more than 500 hours is desirable.

Furthermore, in the present invention, a ratio of the Co content to the Mo content is desirably in a range of 0.2~5, more desirably in a range of 0.4~2.0.

Table 1 indicates a broad range, a desirable range, a preferable range, an optimum range, and the best of the alloy composition relating to the present invention.

The Ni base superalloy relating to the present invention described above comprises desirably γ phases composed of single crystals.

TABLE 1

| Claims | Broad range (% by weight) | Desirable range (% by weight) | Preferable range (1) (% by weight) | Optimum range (% by weight) | Best range (% by weight) |
|---|---|---|---|---|---|
| C | 0.03~0.20 | 0.06~0.15 | 0.06~0.10 | 0.06~0.10 | 0.07 |
| B | 0.004~0.05 | 0.015~0.04 | 0.018~0.04 | 0.018~0.035 | 0.02 |
| Hf | utmost 1.5 | 0.01~1.0 | 0.1~less than 0.5 | 0.2~0.3 | 0.25 |
| Zr | 0.02~0.15 | utmost 0.02 | utmost 0.015 | — | 0 |
| Cr | 1.5~16.0 | 4~12.5 | 6.5~8.5 | 6.9~7.3 | 7.1 |
| Mo | utmost 6.0 | utmost 4.5 | 0.4~3.0 | 0.7~2.0 | 0.83 |
| W | 2.0~12.0 | 5.0~10.0 | 5.5~9.5 | 7.0~9.0 | 8.8 |
| Re | 0.1~9.0 | 0.5~7.0 | 1.0~6.0 | 1.2~2.0 | 1.42 |
| Ta | 2.0~12.0 | 5.0~12.0 | 6.0~10.5 | 8.5~9.5 | 8.9 |
| Nb | 0.3~4.0 | 0.3~3.0 | 0.3~1.55 | 0.6~1.0 | 0.8 |
| Al | 4.0~6.5 | 4.0~6.0 | 4~6 | 4~6 | 5.08 |
| Ti | less than 0.4 | less than 0.4 | less than 0.4 | less than 0.40 | 0 |
| Co | utmost 9.0 | 0.5~5.0 | 0.5~2.5 | 0.5~1.2 | 1.0 |
| Ni | balance 1) | balance | balance | balance | balance |

| Claims | Preferable range (2) (% by weight) | Preferable range (3) (% by weight) |
|---|---|---|
| C | 0.04~0.15 | 0.06~0.10 |
| B | 0.010~0.030 | 0.015~0.025 |
| Hf | 0.15~0.35 | 0.15~0.35 |
| Zr | utmost 0.01 | utmost 0.005 |
| Cr | 6.0~8.5 | 6.5~8.0 |
| Mo | 0.4~2.5 | 0.7~2.0 |
| W | 7.0~10.5 | 8.0~9.5 |
| Re | 0.5~2.5 | 1.0~2.0 |
| Ta | 7.0~10.5 | 8.0~9.5 |
| Nb | 0.4~2.5 | 0.6~2.0 |
| Al | 4.0~6.5 | 4.0~6.5 |
| Ti | utmost 0.03 | utmost 0.01 |
| Co | 0.5~1.7 | 0.5~1.7 |
| Ni | balance | balance |

Remarks: 1): The C content is at least a value obtained by subtracting 5.45 times of the B content from 0.15.

DESCRIPTION OF THE PREFERRED EMBODIMENTS

Embodiment 1

Figure 1:
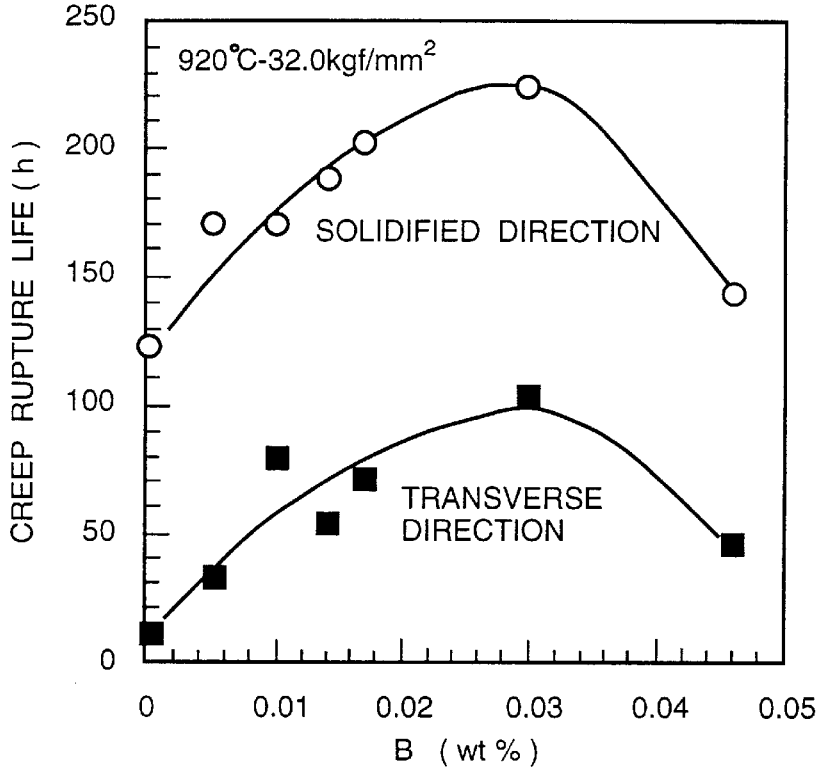
FIG. 1 is a graph indicating a relationship between B content and the creep rupture strength in the solidified direction and the direction perpendicular to the solidified direction (transverse direction) when C content is approximately 0.1% by weight and Hf and Zr contents are substantially nil.

Table 2 indicates a relationship between additive amounts of chemical elements for grain boundary strength, and the high temperature strength and the grain boundary strength, when C, B, Hf, and B are added as the chemical elements for grain boundary strength. The base alloy of the samples in Table 2 had a composition of 7.8Cr-7.2W-1.8Mo-4.7Al-1.6Nb-7.5Ta-1.6Re-balance Ni in % by weight, respectively. The chemical elements for grain boundary strength were added to an equiaxed grain master ingot of the base alloy, which was prepared by a vacuum induction melting method, in an unidirectional solidification furnace, and cast to columnar grained slabs of 15 mm×100 mm×100 mm. Then, a few blocks of 10 mm×10 mm×10 mm were cut out from the columnar grained slabs. The blocks were heat treated for two hours at 1250, 1260, 1270, 1280, 1290, 1300, 1310, 1320, 1330° C., respectively. Subsequently, optimum conditions of solution heat treatment for the respective composition were decided from structure observation of the respective blocks after the heat treatment. More precise optimum conditions for solution heat treatment were investigated on some of the alloys depending on necessity by varying more finely the temperature for the heat treatment. The optimum condition for the solution heat treatment means the highest temperature below the incipient melting temperature, which is capable of arranging γ' phases into shapes of rectangular parallelepiped having an edge equal to or less than 0.5 μm in a region at least 50% in volumetric fraction. The conditions for the solution heat treatment, which were determined by the experiments described above and applied practically to respective of the alloys, are indicated in Table 2. After the solution heat treatment, the alloys were cooled by air, and subsequently, aging heat treatment were performed under a same condition for all the alloys as 1080° C./4 hours/air cooling +871° C./20 hours/air cooling.

The high temperature strength was evaluated with the creep rupture strength of a test piece, which was taken from the columnar grained slab in the solidified direction, determined in the condition at 920° C., and 32 kgf/mm$^2$. Hereinafter, the creep rupture strength obtained in the manner described above is called as the creep rupture strength in the solidified direction. The grain boundary strength was evaluated with both the creep rupture strength of a test piece, which was taken from the columnar grained slab in the direction perpendicular to the solidified direction (hereinafter called the transverse direction), that is, the test piece was taken so that a stress axis becomes perpendicular to the grain boundary, determined in the condition at 920° C. and 32 kgf/mm$^2$, and the high temperature tensile strength at 800° C. The observed results are shown in Table 2.

TABLE 2

| | Grain boundary strengthening elements (wt. %) | | | | Creep rupture strength in solidified direction | | |
|---|---|---|---|---|---|---|---|
| No. | C | B | Hf | Zr | Rupture life (h) | Elongation (%) | Red. area (%)[1)] |
| 1 | 0.09 | 0.014 | <0.001 | <0.001 | 188.4 | 15.5 | 20.5 |
| 2 | 0.12 | 0.005 | <0.001 | <0.001 | 170.6 | 13.8 | 19.0 |
| 3 | 0.10 | 0.017 | <0.001 | <0.001 | 201.9 | 31.5 | 23.4 |
| 4 | 0.09 | <0.002 | <0.001 | <0.001 | 123.5 | 7.0 | 9.8 |
| 5 | 0.19 | 0.011 | <0.001 | <0.001 | 85.6 | 10.8 | 14.4 |
| 6 | 0.15 | 0.012 | <0.001 | <0.001 | 102.6 | 26.0 | 8.2 |
| 7 | 0.002 | 0.008 | <0.001 | <0.001 | 359.5 | 11.5 | 14.4 |
| 8 | <0.002 | <0.002 | <0.001 | <0.001 | 0.5 | 2.0 | 1.7 |
| 9 | 0.10 | 0.010 | <0.001 | <0.001 | 169.8 | 16.0 | 14.4 |
| 10 | 0.10 | 0.010 | 0.54 | <0.001 | 158.1 | 21.2 | 23.4 |
| 11 | 0.09 | 0.011 | 0.92 | <0.001 | 137.0 | 22.0 | 34.7 |
| 12 | 0.10 | 0.012 | 1.40 | <0.001 | 114.1 | 26.5 | 30.6 |
| 13 | 0.09 | 0.012 | <0.001 | 0.005 | 200.7 | 13.8 | 22.0 |
| 14 | 0.09 | 0.010 | <0.001 | 0.009 | 180.1 | 12.5 | 12.9 |
| 15 | 0.10 | 0.010 | <0.001 | 0.014 | 184.9 | 12.7 | 16.0 |
| 16 | 0.10 | 0.011 | <0.001 | 0.019 | 184.8 | 15.0 | 24.9 |
| 17 | <0.002 | 0.027 | <0.001 | <0.001 | 329.3 | 22.4 | 33.3 |
| 18 | <0.002 | 0.046 | <0.001 | <0.001 | 237.4 | 18.2 | 22.0 |
| 19 | 0.10 | 0.030 | <0.001 | <0.001 | 224.3 | 17.0 | 16.0 |
| 20 | 0.10 | 0.046 | <0.001 | <0.001 | 143.4 | 8.8 | 14.4 |
| 21 | 0.07 | 0.016 | <0.001 | <0.001 | 199.9 | 14.7 | 12.9 |
| 22 | 0.03 | 0.011 | <0.001 | <0.001 | 261.0 | 13.8 | 20.5 |
| 23 | 0.10 | 0.011 | 0.26 | <0.001 | 157.0 | 18.9 | 22.0 |
| 24 | 0.10 | 0.011 | <0.001 | 0.13 | 117.0 | 13.8 | 26.3 |
| 25 | 0.10 | 0.011 | <0.001 | 0.06 | 156.0 | 19.2 | 22.0 |

| | Creep rupture strength in transverse direction | | | Tensile strength at 800° C. in transverse direction | | | Solution heat |
|---|---|---|---|---|---|---|---|
| No | Rupture life (h) | Elongation (%) | Red. area (%)[1)] | Rupture life (h) | Elongation (%) | Red. area (%)[1)] | treatment temperature (°C.) |
| 1 | 55.0 | 1.5 | 6.6 | 78.5 | 1.1 | 2.3 | 1305 |
| 2 | 33.1 | 1.0 | 1.7 | 73.3 | 1.5 | 0.8 | 1320 |
| 3 | 71.3 | 1.8 | 4.9 | 69.7 | 0 | 0 | 1305 |
| 4 | 10.5 | 1.7 | 6.6 | 56.3 | 0.2 | 0.4 | 1320 |
| 5 | 44.0 | 2.8 | 1.7 | 85.6 | 0.6 | 3.2 | 1320 |
| 6 | 48.6 | 1.2 | 1.7 | 77.7 | 1.2 | 1.4 | 1320 |
| 7 | 35.1 | 1.5 | 14.4 | 87.1 | 0 | 0 | 1305 |
| 8 | 0.1 | 1.2 | 1.7 | 57.4 | 0.3 | 0.4 | 1305 |
| 9 | 80.2 | 3.2 | 3.3 | 90.6 | 1.6 | 4.5 | 1310 |
| 10 | 35.6 | 2.3 | 0.0 | 95.5 | 1.8 | 4.4 | 1258 |
| 11 | 45.0 | 2.0 | 1.7 | 92.4 | 2.3 | 5.1 | 1258 |
| 12 | 78.8 | 11.0 | 16.0 | 109.2 | 3.9 | 10.3 | 1258 |
| 13 | 50.5 | 2.7 | 0.0 | 80.6 | 0.8 | 2.5 | 1305 |
| 14 | 38.1 | 1.8 | 0.0 | 89.4 | 1.1 | 2.9 | 1305 |
| 15 | 70.5 | 1.7 | 3.3 | 83.9 | 0.6 | 4.8 | 1305 |
| 16 | 83.6 | 3.0 | 0.0 | 76.9 | 0.6 | 3.4 | 1305 |
| 17 | 14.6 | 1.7 | 0.0 | 96.8 | 2 | 2.1 | 1260 |
| 18 | 56.5 | 2.3 | 1.7 | 82.3 | 0.9 | 1.7 | 1260 |
| 19 | 105.5 | 4.0 | 1.7 | 97.5 | 1.4 | 3.5 | 1270 |
| 20 | 46.3 | 1.1 | 1.7 | 79.8 | 1.3 | 1.7 | 1270 |

TABLE 2-continued

| | | | | | | | |
|---|---|---|---|---|---|---|---|
| 21 | 63.4 | 1.8 | 0.0 | 80.9 | 1.2 | 1.7 | 1305 |
| 22 | 4.7 | 0.7 | 0.0 | 82 | 0.5 | 1.4 | 1305 |
| 23 | 101.2 | 2.7 | 0.0 | 100.5 | 1.5 | 1.4 | 1260 |
| 24 | 57.6 | 2.4 | 1.7 | 93.6 | 2.6 | 8.2 | 1260 |
| 25 | 94.6 | 4.0 | 3.3 | 86.9 | 0.2 | 1.1 | 1270 |

[1)]Red. area: Reduction in area

The test pieces for both the creep rupture test and the high temperature tensile test were 6 mm in diameter and 30 mm for the gauge length. These test pieces as a whole can be regarded as having the same characteristics in the solidified direction as a test piece made of a single crystal.

The width of a crystal grain in the unidirectionally solidified slab was approximately 1~5 mm at solidification starting portion (bottom side) and 5~10 mm at upper portion. The test pieces for determining strength in the transverse direction were taken from the middle portion of the slab (the width of the crystal grain was approximately 5 mm). Accordingly, approximately 5 grain boundaries existed in the gauge length. The test pieces for determining strength in the solidified direction were not taken from a specified portion. In an extreme case, a single crystal in the gauge length can be assumed. However, ordinarily, 3 grain boundaries existed.

FIG. 1 indicates relationship between B content and the creep rupture strength in the solidified direction and the transverse direction when C content is approximately 0.1% by weight and Hf and Zr contents are substantially nil. In this case, the optimum additive amount of B exists at approximately 0.03% in both the solidified direction and the transverse direction. In considering that conventional additive amount of B in columnar grained alloys is at a level of 0.015%, the result shown in FIG. 1 indicates that the actual optimum additive amount of B is approximately as double as much the conventionally regarded optimum additive amount of B. The additive amount of B in a range of 0.017~0.040% gives a high strength.

Figure 2:
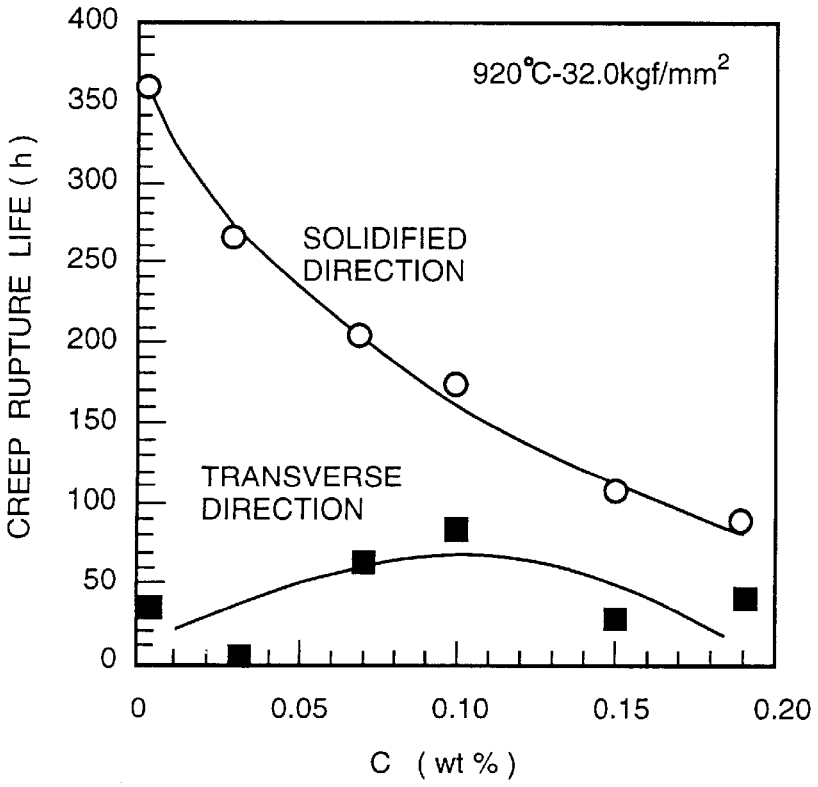
FIG. 2 is a graph indicating a relationship between C content and the creep rupture strength in the solidified direction and the direction perpendicular to the solidified direction (transverse direction) when B content is approximately 0.01% by weight and Hf and Zr contents are substantially nil.
Figure 3:
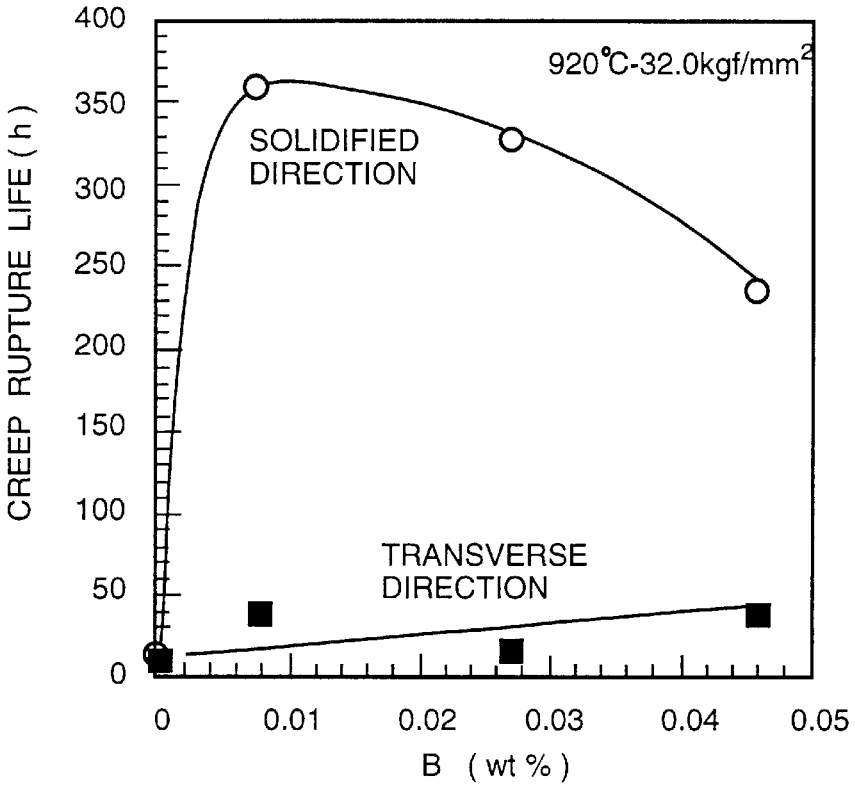
FIG. 3 is a graph indicating a relationship between B content and the creep rupture strength in the solidified direction and the direction perpendicular to the solidified direction (transverse direction) when C, Hf, and Zr contents are substantially nil.

FIG. 2 indicates a relationship between C content and the creep rupture strength in the solidified direction and the transverse direction when B content is approximately 0.01% by weight and Hf and Zr contents are substantially nil. And, FIG. 3 indicates a relationship between B content and the creep rupture strength in the solidified direction and the transverse direction when C, Hf, and Zr contents are substantially nil. From FIGS. 2 and 3, it is revealed that the creep rupture strength in the solidified direction is decreased by addition of C, but C is an indispensable chemical element for obtaining the strength in the transverse direction. Accordingly, in order to make the high temperature strength and the grain boundary strength compatible, the additive amount of C should be controlled precisely. Furthermore, in accordance with controlling the additive amount of C, an alloy which emphasizes either of the high temperature strength or the grain boundary strength can be obtained. Practically, when the high temperature strength is important, the additive amount of C should be as low as practically possible, and when the grain boundary strength is more important than the high temperature strength, the additive amount of C should be as much as practically possible.

Figure 4:
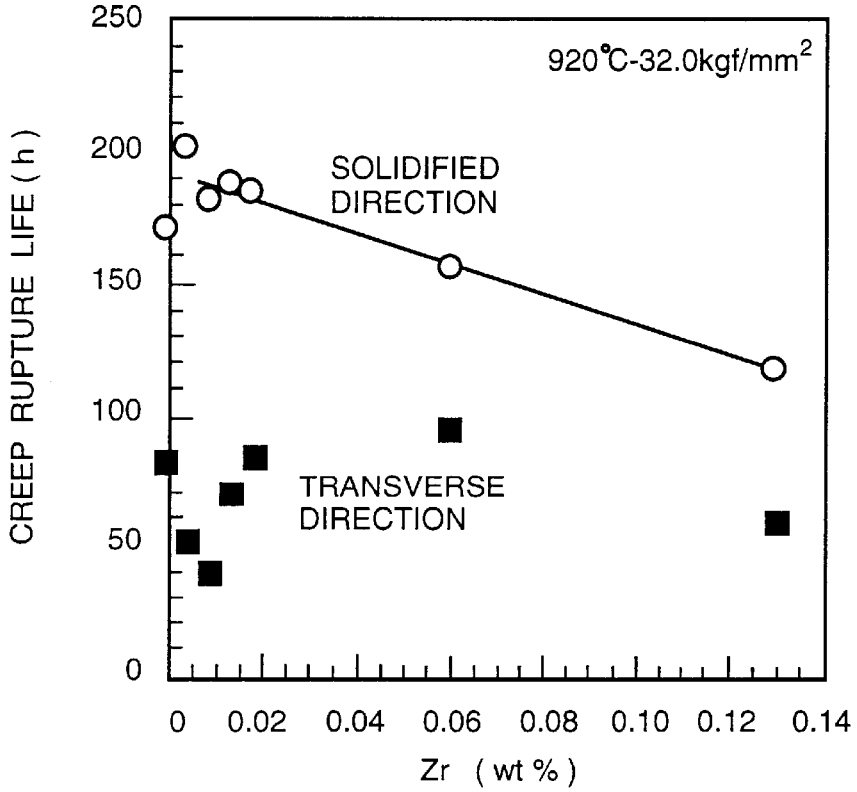
FIG. 4 is a graph indicating a relationship between Zr content and the creep rupture strength in the solidified direction and the direction perpendicular to the solidified direction (transverse direction) when C content is approximately 0.1% by weight, B content is approximately 0.01% by weight, and Hf content is substantially nil.
Figure 5:
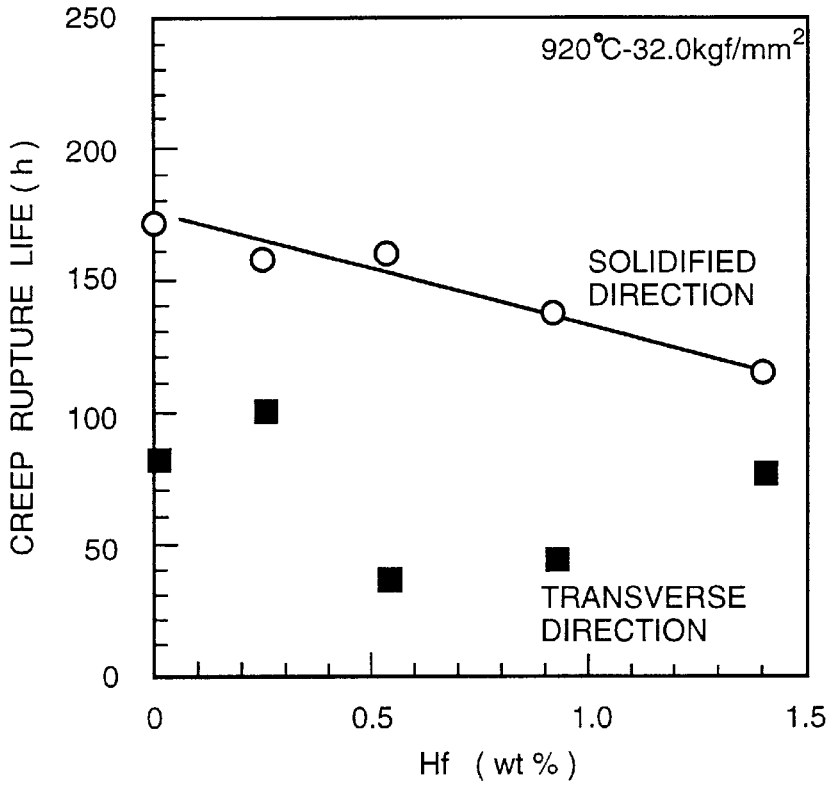
FIG. 5 is a graph indicating a relationship between Hf content and the creep rupture strength in the solidified direction and the direction perpendicular to the solidified direction (transverse direction) when C content is approximately 0.1% by weight, B content is approximately 0.01% by weight, and Zr content is substantially nil.
Figure 6:
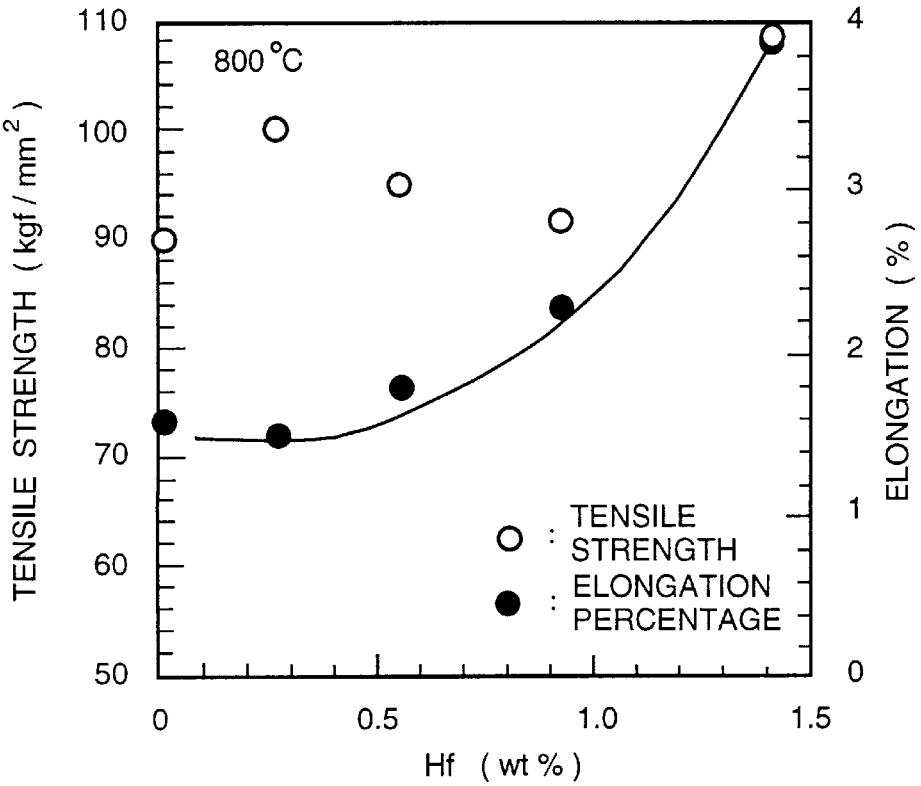
FIG. 6 is a graph indicating a relationship between Hf content and the high temperature tensile strength in the solidified direction and the direction perpendicular to the solidified direction (transverse direction) when C content is approximately 0.1% by weight, B content is approximately 0.01% by weight, and Zr content is substantially nil.

FIGS. 4 and 5 indicate respectively a relationship between Zr content, or Hf content and the creep rupture strength in the solidified direction and the transverse direction when C content is approximately 0.1% by weight, and B content is approximately 0.01% by weight. From FIGS. 4 and 5, it is revealed that increasing additive amounts of Zr and Hf decreases the creep rupture strength in the solidified direction, and hardly improve the creep rupture strength in the transverse direction. However, Hf has an effect to improve tensile ductility in the transverse direction as shown in FIG. 6.

Embodiment 2

An equiaxed grain master ingot of the respective alloys, of which composition are indicated in Table 3, was prepared by a vacuum induction melting method, and cast by an unidirectional solidification furnace into columnar grained slabs of 15 mm×100 mm×220 mm. Then, a few blocks of 10 mm×10 mm×10 mm were cut out from respective of the columnar grained slabs as same as the alloys 1~25. The blocks were heat treated for two hours at 1250, 1260, 1270, 1280, 1290, 1300, 1310, 1320, 1330° C., respectively, for studying preliminarily the optimum conditions of solution heat treatment. On the basis of results of the preliminary study, a multi-stage solution heat treatment was performed. In accordance with the solution heat treatment, the heat treatment temperature was elevated from 1250° C./4 hours to the maximum temperature of the solution heat treatment shown in Table 2 by 10° C./4 hours steps. The test piece was maintained at the maximum temperature for 4 hours, then, cooled by air.

Subsequent aging heat treatment was performed under a same condition for all the alloys as 1080° C./4 hours/air cooling +871° C./20 hours/air cooling.

Results of evaluating characteristics of respective alloys are indicated concurrently in Table 3. Among the above tests, the test pieces for the creep rupture test and the high temperature tensile test were taken as the same method as the example 1~25, and shape of the test pieces was also as same as the example 1~25. The creep rupture test in the solidified direction was performed at 1040° C. with a stress of 14 kgf/mm$^2$, the creep rupture test in the transverse direction was performed at 927° C. with a stress of 32 kgf/mm$^2$, and the tensile test in the transverse direction was performed at 800° C.

A corrosion resistance test was performed on some of the alloys by a burner rig method. The test piece was a rod of 9 mm in diameter and 50 mm long, and decrease in weight of the descaled test piece was determined after exposing into an atmosphere simulating gas turbine operating condition at 900° C./7 hours/air cooling×7 times.

TABLE 3

| | Alloy composition (wt. %) | | | | | |
|---|---|---|---|---|---|---|
| No. | Cr | Ti | Mo | Nb | W | Ta |
| 38 | 7.54 | — | 0.83 | 1.71 | 7.21 | 8.77 |
| 49 | 7.27 | — | 0.83 | — | 7.00 | 11.83 |
| 50 | 7.40 | — | 0.83 | 0.85 | 7.11 | 10.31 |
| 51 | 7.15 | — | 0.83 | 0.85 | 8.99 | 8.70 |
| 52 | 6.74 | — | 2.51 | 0.86 | 6.57 | 8.79 |
| 53 | 7.45 | — | 0.83 | 1.61 | 7.08 | 8.70 |
| 54 | 7.54 | — | 0.83 | 1.71 | 7.21 | 8.77 |
| 55 | 7.27 | — | 0.83 | 0.85 | 8.07 | 9.50 |
| 56 | 7.21 | — | 0.83 | 0.85 | 8.53 | 9.10 |
| 57 | 7.29 | — | 0.84 | 0.86 | 7.80 | 8.79 |
| 58 | 7.36 | — | 0.84 | 0.86 | 6.56 | 8.78 |
| 59 | 7.35 | — | 0.83 | 0.85 | 6.79 | 9.50 |
| 60 | 7.50 | — | 0.84 | 0.86 | 5.61 | 9.59 |
| 61 | 7.10 | — | 0.83 | 0.80 | 8.80 | 8.90 |
| 62 | 7.18 | — | 0.83 | 0.85 | 8.76 | 8.90 |
| 100 | 7.54 | — | 0.83 | 1.71 | 7.21 | 8.77 |
| 101 | 7.36 | — | 0.82 | 1.68 | 7.05 | 8.57 |
| 102 | 7.20 | — | 0.80 | 1.64 | 6.89 | 8.38 |
| 103 | 6.89 | — | 0.76 | 1.57 | 6.59 | 8.02 |
| 104 | 6.60 | — | 0.73 | 1.50 | 6.32 | 7.68 |
| 105 | 5.75 | — | 0.82 | 0.84 | 8.89 | 8.61 |
| 106 | 4.23 | — | 0.81 | 0.83 | 8.80 | 8.52 |
| 107 | 4.27 | — | 0.81 | 0.83 | 7.56 | 8.52 |
| 108 | 7.33 | — | 0.41 | 0.85 | 9.00 | 8.72 |
| 109 | 7.67 | — | 0.84 | 2.59 | 7.32 | 7.22 |
| 110 | 7.22 | 0.38 | 0.83 | 0.43 | 6.93 | 8.72 |
| 114 | 7.79 | — | 0.88 | 0.81 | 9.35 | 8.18 |
| 115 | 6.50 | — | 0.77 | 0.89 | 8.62 | 9.23 |
| 116 | 9.79 | — | 0.84 | 0.87 | 6.63 | 8.88 |
| 117 | 11.73 | — | — | 1.77 | 5.59 | 7.42 |
| 118 | 7.58 | 1.17 | 0.84 | 0.86 | 9.01 | 6.43 |
| 119 | 7.19 | — | 0.84 | 0.87 | 8.41 | 7.25 |
| 120 | 7.23 | — | 0.86 | 0.88 | 7.90 | 5.74 |
| 121 | 6.15 | — | 4.21 | 0.87 | 6.09 | 7.25 |

| | Alloy composition (wt. %) | | | | | |
|---|---|---|---|---|---|---|
| No. | Re | Co | Al | C | B | Hf |
| 38 | 1.44 | 1.00 | 4.96 | 0.066 | 0.032 | 0.28 |
| 49 | 1.43 | 1.01 | 5.18 | 0.061 | 0.026 | 0.28 |
| 50 | 1.44 | 1.01 | 5.07 | 0.067 | 0.026 | 0.28 |
| 51 | 1.43 | 0.99 | 5.07 | 0.064 | 0.025 | 0.28 |
| 52 | 1.45 | 1.00 | 5.14 | 0.069 | 0.026 | 0.28 |
| 53 | 2.86 | 1.01 | 4.95 | 0.069 | 0.025 | 0.29 |
| 54 | 1.44 | 0.97 | 4.96 | 0.066 | 0.022 | 0.28 |
| 55 | 1.43 | 1.01 | 5.07 | 0.061 | 0.025 | 0.26 |
| 56 | 1.43 | 1.02 | 5.07 | 0.061 | 0.024 | 0.27 |
| 57 | 1.45 | 1.02 | 5.20 | 0.069 | 0.026 | 0.25 |
| 58 | 2.89 | 1.01 | 5.28 | 0.071 | 0.029 | 0.26 |
| 59 | 2.87 | 1.01 | 5.15 | 0.061 | 0.027 | 0.25 |
| 60 | 2.89 | 1.01 | 5.27 | 0.066 | 0.026 | 0.26 |
| 61 | 1.42 | 1.00 | 5.08 | 0.070 | 0.020 | 0.25 |
| 62 | 1.43 | 1.00 | 5.07 | 0.070 | 0.021 | 0.25 |
| 100 | 1.44 | 0.00 | 4.96 | 0.070 | 0.023 | 0.21 |
| 101 | 1.41 | 2.31 | 4.85 | 0.060 | 0.025 | 0.26 |
| 102 | 1.38 | 4.51 | 4.74 | 0.061 | 0.026 | 0.25 |
| 103 | 1.32 | 8.63 | 4.53 | 0.060 | 0.024 | 0.24 |
| 104 | 1.26 | 12.40 | 4.35 | 0.062 | 0.026 | 0.24 |
| 105 | 2.83 | 0.89 | 5.10 | 0.061 | 0.025 | 0.22 |
| 106 | 4.27 | 0.99 | 5.12 | 0.061 | 0.026 | 0.24 |
| 107 | 5.61 | 0.99 | 5.20 | 0.070 | 0.030 | 0.22 |
| 108 | 1.44 | 1.01 | 5.12 | 0.060 | 0.022 | 0.25 |
| 109 | 1.45 | 1.05 | 4.85 | 0.088 | 0.032 | 0.28 |
| 110 | 1.44 | 1.20 | 5.03 | 0.078 | 0.033 | 0.21 |
| 114 | 1.57 | 0.98 | 4.75 | 0.062 | 0.024 | 0.21 |
| 115 | 1.29 | 0.98 | 5.40 | 0.065 | 0.022 | 0.21 |
| 116 | 1.46 | 1.01 | 5.17 | 0.075 | 0.029 | 0.29 |
| 117 | 1.49 | 0.99 | 5.20 | 0.080 | 0.031 | 0.25 |
| 118 | 1.45 | 0.55 | 4.78 | 0.088 | 0.033 | 0.25 |
| 119 | 1.46 | 1.01 | 5.34 | 0.070 | 0.025 | 0.26 |
| 120 | 1.48 | 1.02 | 5.62 | 0.081 | 0.028 | 0.26 |
| 121 | 1.46 | 1.00 | 5.21 | 0.061 | 0.036 | 0.21 |

| | Creep rupture life (hours) | | Tensile strength Trans- | Decrease in weight | Final solution heat |
|---|---|---|---|---|---|
| No. | Solidified direction | Trans-verse direction | verse direction (kgf/mm$^2$) | by corro-sion (mg/cm$^2$) | treatment condition (° C./4 hours) |
| 38 | 333.5 | 85.1 | 98.2 | 10.8 | 1270 |
| 49 | 328.3 | 60.1 | 95.1 | 29.9 | 1280 |
| 50 | 388.9 | 78.0 | 112.6 | 17.4 | 1280 |
| 51 | 665.1 | 74.5 | 108.7 | 19.3 | 1280 |
| 52 | 507.3 | 57.3 | 94.3 | 55.6 | 1280 |
| 53 | 244.8 | 80.4 | 100.1 | 7.8 | 1270 |
| 54 | 232.2 | 46.1 | 110.3 | 12.3 | 1270 |
| 55 | 509.9 | 48.6 | 99.0 | 17.3 | 1280 |
| 56 | 525.5 | 50.0 | 98.2 | 16.1 | 1280 |
| 57 | 430.0 | 45.7 | 111.5 | 15.8 | 1280 |
| 58 | 436.5 | 73.2 | 103.3 | 8.8 | 1280 |
| 59 | 433.4 | 38.4 | 115.9 | 9.1 | 1280 |
| 60 | 415.4 | 48.6 | 110.4 | 6.6 | 1280 |

TABLE 3-continued

| | | | | | |
|---|---|---|---|---|---|
| 61 | 555.5 | 66.7 | 105.5 | 15.5 | 1280 |
| 62 | 611.1 | 70.7 | 107.7 | 17.7 | 1280 |
| 100 | 323.3 | 78.8 | 97.9 | 36.5 | 1270 |
| 101 | 298.7 | 79.7 | 93.6 | 27.7 | 1270 |
| 102 | 275.3 | 75.9 | 95.5 | 31.0 | 1270 |
| 103 | 240.4 | 77*3 | 96.3 | 34.4 | 1270 |
| 104 | 211.1 | 55.4 | 94.4 | 35.5 | 1270 |
| 105 | 508.9 | 60.5 | 110.9 | — | 1280 |
| 106 | 460.6 | 66.6 | 111.3 | — | 1280 |
| 107 | 454.3 | 78.8 | 114.4 | — | 1280 |
| 108 | 588.8 | 78.0 | 107.7 | 12.5 | 1280 |
| 109 | 220.3 | 35.5 | 95.1 | — | 1250 |
| 110 | 610.1 | 64.5 | 101.8 | 9.5 | 1280 |
| 114 | 580.9 | 64.4 | 101.2 | — | 1280 |
| 115 | 550.3 | 65.3 | 105.5 | — | 1280 |
| 116 | 220.3 | 38.3 | 97.7 | — | 1260 |
| 117 | 205.5 | 35.5 | 89.9 | — | 1250 |
| 118 | 220.5 | 33.3 | 95.5 | — | 1250 |
| 119 | 351.2 | 37.7 | 91.2 | — | 1280 |
| 120 | 311.1 | 33.3 | 88.8 | — | 1280 |
| 121 | 477.5 | 73.3 | 96.5 | 88.8 | 1280 |

Remarks: Zirconium (Zr) is nil in all alloys.

As shown in Table 3, an addition of at least 2% at minimum, desirably at least 5% Tantalum (Ta) is desirable in order to improve the high temperature strength, and a optimum additive amount of Ta for obtaining the high temperature strength exists in a range of 8.5~9.5%. On the other hand, the addition of a large amount of Ta increases the solves of γ' phase as described previously. Accordingly, if an excess amount of Ta is added, difference between the temperature of incipient melting and the solves becomes small, and an amount of precipitation hardening of the alloy is decreased, because a region which is capable of making the γ' phase solution without generating the incipient melting is decreased. The addition of Ta exceeding 12% is not effective for improving the high temperature strength. Therefore, the maximum additive amount of Ta is desirably designated as utmost 10%.

Based on the observation of the alloys No. 38, and 100~104, wherein only the additive amount of Cobalt (Co) was varied under a condition wherein additive amounts of other chemical elements to the alloy were unchanged, increasing of the additive amount of Co clearly decreases the high temperature strength. Accordingly, the maximum additive amount of Co is designated as utmost 9%, desirably less than 9%, preferably in the range of 0.5~5%, in consideration of the high temperature strength. Especially, the addition of Co in a range of 0.5~1.2% has an effect to improve corrosion resistance of the alloy.

Tungsten (W) and Rhenium (Re) are effective for improving the high temperature strength by making the alloy solution hardening, and the addition of at least 2%, preferably 5%, and 0.1%, preferably at least 1%, respectively, are desirable. When the high temperature strength is regarded as more important, the addition of at least 5.5% and at least 1.2%, respectively, are preferable. On the other hand, the effects of adding these elements is saturated by adding a restricted amount of the elements, and the addition of an excessive amount of the elements causes decrease of the high temperature strength. Because, if these elements are added excessively beyond a limit of solid solution, needle or plate precipitates , which are mainly composed of W or Re, are precipitated. Accordingly, the upper limits of the additive amount of W and Re are desirably 12%, preferably 10%, and 9%, preferably6%, respectively. Furthermore, in order to suppress precipitation of a large amount of the precipitates, the additive amount of W and Re are preferably utmost 9.5% and utmost 3.1%, respectively. The most optimum additive amount of W to the alloy relating to the present invention is in a range of 8.0~9.0%, and the most optimum additive amount of Re is in a range of 1.2~1.6%. Furthermore, an addition of W in the range of 5~10%, preferably 5.5~9.5%, is desirable, and an addition of Re in the range of 1~6%, preferably 1.2~3.1%, is desirable The most optimum additive amount of W and Re is desirably considered with a sum of the respective additive amount of W and Re. The high temperature strength becomes maximum when the amount of (W+Re) is in a range of 9.5~12%. On the contrary, when the amount of (W+Re) is less than 9.5%, the high temperature strength is decreased, because solution hardening of the alloy becomes deficient. When the amount of (W+Re) exceeds 12%, the creep strength at higher than 1000° C. is decreased significantly, because a large amount of the precipitates are precipitated.

Aluminum (Al) is an indispensable element for forming γ' phase, which is one of strengthening factors of the Ni base superalloy. Furthermore, Al contributes to improvement of oxidation resistance and hot corrosion resistance of the alloy by forming $Al_2O_3$ coating film on surface of the alloy. Accordingly, the additive amount of Al is at least 4.0% at minimum, desirably at least 4.5%. However, an excess addition of Al over 6.5% increases the amount of eutectic γ' phase in the alloy. The alloy of the present invention is considered to have a preferable high temperature strength even in a condition wherein the perfect solution heat treatment is not performed, by optimizing the additive amounts of chemical elements which are effective to the solution hardening of the alloy. Therefore, the alloy has a preferable high temperature strength even in a condition wherein the eutectic γ' phase exists. However, in view of creep damage, an existence of small amount of the eutectic γ' phase is preferable, because the eutectic γ' phase finally becomes an origin of cleavage and shortens the rupture life of the alloy. Accordingly, the additive amount of Al is desirably utmost 6.5%, preferably utmost 5.7%. Especially, the range of 4.7~5.4% is desirable, and the range of 4.9~5.2% is preferable.

Chromium (Cr) is desirably added to the alloy at least 1.5%, preferably at least 4%, because Cr has an effect to improve hot corrosion resistance and oxidation resistance of the alloy by forming $Cr_2O_3$ coating film on surface of the alloy. However, an excessive addition of Cr enhances precipitation of the above precipitates mainly composed of W and Re, and consequently, the additive amount of W and Re, which are effective for ensuring the high temperature strength, should be decreased. Accordingly, when the high temperature strength is important, the upper limit of the additive amount of Cr is desirably designated as 16%, preferably 12.5%. Especially, the range of 6.5~8.5%, preferably 6.9~7.3%, is desirable.

Molybdenum (Mo) has the same effect as w and Re. However, Mo decreases remarkably the hot corrosion resistance of the alloy in a combustion gas atmosphere. Therefore, when the hot corrosion resistance is important, the additive amount of Mo is desirably restricted to utmost 6%, preferably utmost 4.5%. When the hot corrosion resistance is further important, the additive amount of Mo is desirably restricted to the range of 0.4~1%, preferably 0.7~1%.

Niobium (Nb) is an element in the same group as Ta, and has approximately the same effect as Ta to the high temperature strength. Nb is contained in the alloy in the range of 0.3~4%. Furthermore, Nb has an effect to delay migration of Sulfur (S) into inside the alloy and to improve hot corrosion resistance in an environment wherein a large amount of S exists in fuel, because Nb easily forms sulfides. However, in accordance with the present invention, when at least a definite amount of Nb and B exists in the alloy, it has been revealed that a phase mainly composed of Nb and B having a low melting point is formed in the eutectic region, which decreases significantly the incipient melting temperature of the alloy. The phase having the low melting point is generated by segregation during solidifying the alloy, and accordingly, the phase is generated or not generated depending on the casting condition of the alloy. When the phase having the low melting point is generated, the solution heat treatment at a high temperature can not be performed, and consequently, the high temperature strength can not be improved. If a temperature, which is decided based on a result of a preliminary experiment on the specimen cast with a condition which does not generate the phase having the low melting point, is applied to the solution heat treatment of a specimen cast with a condition which generates the phase having the low melting point, the phase having the low melting point melts partly and the high temperature strength decreases significantly. In view of the above result, the preferable additive amount of Nb in the present invention has been decided as the range of 0.3~1%, preferably 0.6~1.0%.

Titanium (Ti) readily forms sulfide as same as Nb, and has an effect to improve hot corrosion resistance in an environment wherein a large amount of S exists in fuel. However, the additive amount of Ti has been decided to be less than 0.4% in the present invention, because Ti also decreases the melting point of the eutectic region as same as Nb. In accordance with the present invention, Ti is not intentionally added to the alloy except being contained as impurity.

When the alloy is used with allowing the existence of grain boundaries as the alloy of the present invention, the amounts of impurities such as Si, Mn, P, S, Mg, Ca, and others, should be restricted strictly. In accordance with the present invention, the above elements were not intentionally added. However, those elements may be contained in the additive elements and Ni as impurities, and may be mixed into the alloy. Accordingly, the alloy of the present invention was cast with restricting respective of the maximum content of those elements as follows:

Si≦=0.05%, Mn≦0.05%, P≦0.005%, S≦0.003%, Mg≦100 ppm, Ca≦100 ppm.

Furthermore, Fe and Cu are also desirably at impurity levels, and both the elements are desirably contained utmost 0.2%, respectively. Gases contained in the alloy are also desirably contained as follows:

N: less than 15 ppm, O: less than 15 ppm.

Rare earth elements such as Y, La, Ce, and the like can be added to the alloy of the present invention. Those elements are effective for improving oxidation resistance, but total amount of those elements should be desirably restricted to utmost 0.5% when those elements are added to the alloy of the present invention, because those elements easily form surface defects by reacting with molding material at the casting, and decrease significantly the incipient melting temperature of the alloy.

In accordance with the present invention, the alloy having the creep rupture life in the solidified direction equal to or more than 350 hours, further 500 hours can be obtained as indicated in Table 3. The creep rupture life in the direction perpendicular to the solidified direction (transverse direction) for the former is 30 hours and for the latter is equal to or more than 45 hours. As the result, the creep rupture life in the solidified direction at 1040° C., 14 kgf/mm$^2$, is at least 350 hours, and the superior creep rupture strength in the transverse direction can be obtained such that the creep rupture life in the transverse direction at 920° C., 32 kgf/mm$^2$, is at least a value which is obtained by subtracting 32.5 from 0.15 times of the creep rupture life in the solidified direction.

Embodiment 3

An equiaxed grain master ingot of the alloy, of which composition are indicated in Table 4 as No. 34, was prepared by a vacuum induction melting method, and cast by an unidirectional solidification furnace into columnar grained slabs of 15 mm×100 mm×220 mm. A preliminary experiment to determine the condition of solution heat treatment were performed on the alloy by the same method as the alloys No. 1~25. Then, test pieces treated with the solution heat treatment at 1275° C., for 1, 4, 20 hours, respectively, were prepared. Further, test pieces which were treated with only aging heat treatment were prepared.

As the comparative alloy, a conventional alloy, i.e. CM186LC for columnar grained casting, was evaluated concurrently. A polycrystalline master ingot of the comparative alloy, of which composition was adjusted aiming to be as same as the composition indicated in Table 2 disclosed in U.S. Pat. No. 5,069,873, was prepared by a vacuum induction melting method, and cast by an unidirectional solidification furnace into columnar grained slabs of 15 mm×100 mm×220 mm. The comparative alloy No.1 was heat treated with a condition disclosed in U.S. Pat. No. 5,069,873, i.e. 1080° C./4 hours/air cooling +871° C./20 hours/air cooling. Furthermore, an optimum temperature for solution heat treatment of the comparative alloy was determined by the same method as the alloys No. 1~25. As the result, the incipient melting point was determined as 1277° C. Therefore, the temperature for the solution heat treatment was designated as 1275° C., and the comparative alloys 2~6, which were prepared by treating at 1275° C. for 1, 4, 8, 20, and 40 hours, respectively, were evaluated.

The alloy No. 34 and the comparative alloys were cooled by air after the solution heat treatment, and subsequently, the alloys were treated under the condition of 1080° C./4 hours/air cooling +871° C./20 hours/air cooling as the aging heat treatment.

Figure 7:
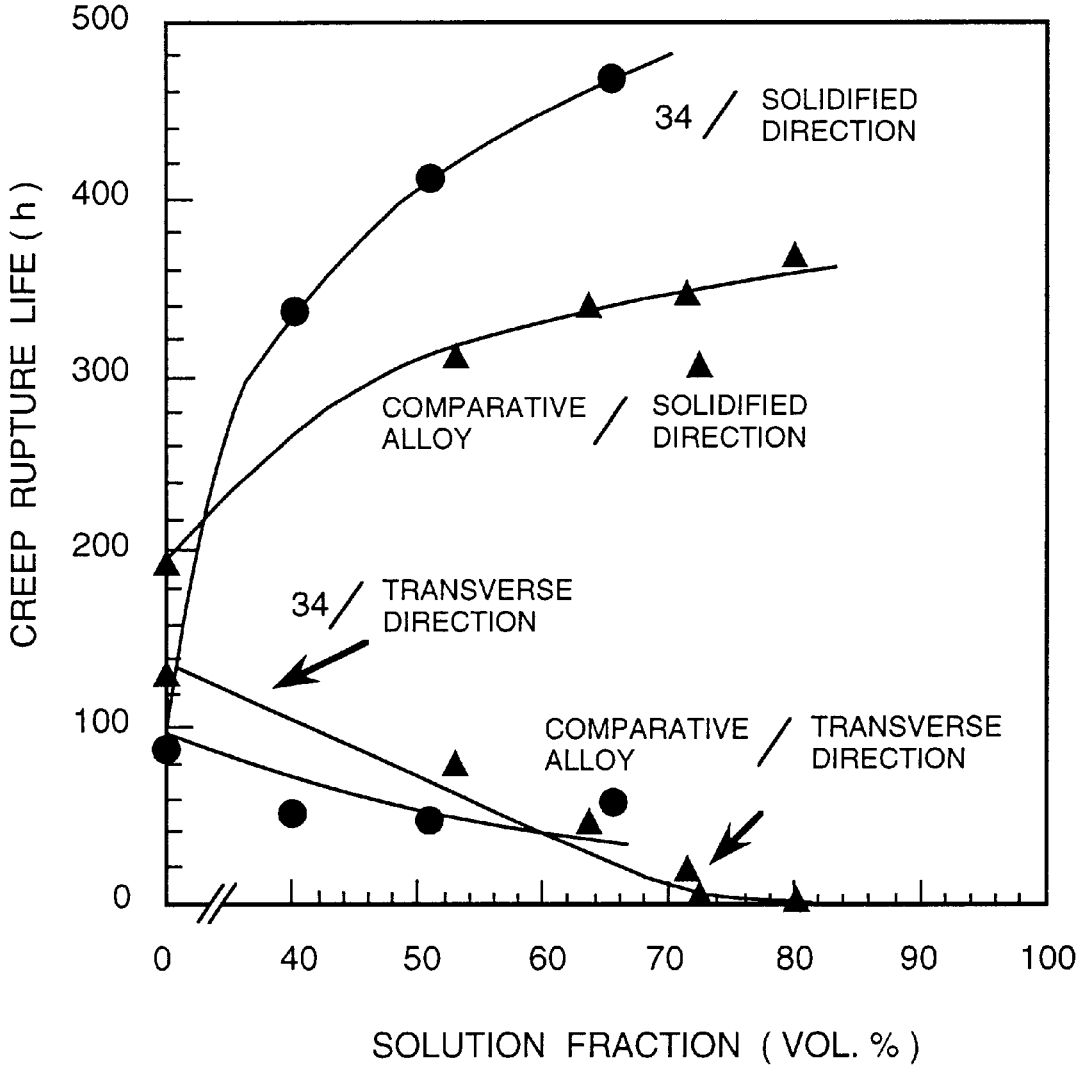
FIG. 7 is a graph indicating a relationship between the alloy of the present invention and a comparative alloy in solution fraction and the creep rupture strength in the solidified direction and the direction perpendicular to the solidified direction (transverse direction).

The creep rupture strength in the solidified direction of the above alloys were evaluated under the condition at 1040° C., 14 kgf/mm$^2$, and the creep rupture strength in the transverse direction of the above alloys were evaluated under the condition at 920° C., 32 kgf/mm$^2$. The results of the evaluation is indicated in Table 3. A relationship between the solution fraction expressed by volume percent, which was determined by image analysis, and the strength in the solidified direction and the strength in the transverse direction is shown in FIG. 7.

TABLE 4

| No. | Condition of sol. heat tr.[1)] | Alloy composition (wt. %) Cr | Ti | Mo | Nb | W | Ta |
|---|---|---|---|---|---|---|---|
| 34-1 | — | 7.62 | — | 1.00 | 1.60 | 6.93 | 8.54 |
| 34-2 | 1275° C./1 h | | | | | | |
| 34-3 | 1275° C./4 h | | | | | | |

TABLE 4-continued

| | | | | | | | | |
|---|---|---|---|---|---|---|---|---|
| 34-4 | 1275° C./20 h | | | | | | | |
| Comp. 1[2)] | — | 6.60 | 0.69 | 0.50 | — | 8.50 | 3.20 | |
| Comp. 2 | 1275° C./1 h | | | | | | | |
| Comp. 3 | 1275° C./4 h | | | | | | | |
| Comp. 4 | 1275° C./8 h | | | | | | | |
| Comp. 5 | 1275° C./20 h | | | | | | | |
| Comp. 6 | 1275° C./40 h | | | | | | | |

| | Alloy composition (wt. %) | | | | | | |
|---|---|---|---|---|---|---|---|
| No. | Re | Co | Al | C | B | Hf | Zr |
| 34-1 | 1.45 | 0.90 | 5.01 | 0.070 | 0.034 | 0.28 | — |
| 34-2 | | | | | | | |
| 34-3 | | | | | | | |
| 34-4 | | | | | | | |
| Comp. 1[2)] | 3.00 | 9.20 | 5.88 | 0.070 | 0.016 | 1.4 | 0.006 |
| Comp. 2 | | | | | | | |
| Comp. 3 | | | | | | | |
| Comp. 4 | | | | | | | |
| Comp. 5 | | | | | | | |
| Comp. 6 | | | | | | | |

| | Creep rupture life (h) | | |
|---|---|---|---|
| No. | Solidified direction | Transverse direction | Solution fraction (vol. %) |
| 34-1 | 87.7 | 85.9 | 0 |
| 34-2 | 334.9 | 51.4 | 39.9 |
| 34-3 | 412.7 | 45.7 | 51.2 |
| 34-4 | 467.2 | 59.1 | 65.7 |
| Comp. 1[2)] | 192.8 | 130.3 | 0 |
| Comp. 2 | 313.6 | 80.6 | 53 |
| Comp. 3 | 343.2 | 48.9 | 63.8 |
| Comp. 4 | 348.9 | 21.7 | 71.3 |
| Comp. 5 | 307.3 | 7.5 | 72.4 |
| Comp. 6 | 370.3 | 2.0 | 80.1 |

Remarks:
[1)]Condition of solution heat treatment
[2)]Comparative alloy

In accordance with the above relationship, it is revealed that the alloy No. 34 has a creep strength in the solidified direction, i.e. the high temperature strength, superior to the comparative alloys with a shorter solution heat treatment time, i.e. a smaller solution fraction, than the comparative alloys. It means that the alloy of the present invention is capable of improving the high temperature strength without decreasing the strength in the transverse direction, i.e. the grain boundary strength. The reason is assumed that the significantly larger amount of Ta contained in the alloy of the present invention than the comparative alloys makes the solves of the γ' phase in the vicinity of the grain boundaries remarkably higher than the solves of inside the grain. Therefore, the γ' phase inside the grain can be made solution without dissolving the γ' phase in the vicinity of the grain boundaries into the γ phase, and accordingly, the strength inside the grain can be improved without diffusing and making B disappeared from the grain boundaries. The superior high temperature strength of the alloy of the present invention to the comparative alloys even with a same solution fraction can be considered as an effect of relatively low content of Co.

Embodiment 4

A master ingot of 150 kg was prepared based on the composition of the sample No. 61 in Table. The result of analysis of the ingot is shown in Table 5. For comparison, the composition of the sample No. 49 in U.S. Pat. No. 5,399,313 is shown concurrently in Table 5. Using the above master ingot, single crystal rod samples were cast by a selector type casting die of melting capacity approximately 3.4 kg for 8 rods of 15 mm diameter×180 mm long. The single crystal structure of the rod sample was confirmed by macro-etching with a mixture of hydrochloric acid and hydrogen peroxide aqueous solution, after the casting of the single crystal rod sample. Crystal orientation of the rod sample was determined by rear Laue X-ray diffraction, and only samples having the crystal orientation in a perpendicular direction of the sample within 10° from <001> orientation were selected. Single crystalline test pieces with collar for determining creep strain of 6.35 mm diameter, and gauge distance 25.4 mm, were cut out from the rod samples. And, creep strength of the single crystalline test piece was determined. The result is shown in Table 6.

TABLE 5

| | C | B | Cr | W | Mo | Co |
|---|---|---|---|---|---|---|
| No. 61 150 kg ingot | 0.07 | 0.020 | 7.20 | 8.82 | 0.86 | 1.09 |
| U.S. Pat. No. 5,399,313 No. 49 | 0.05 | 0.0043 | 9.7 | 6.0 | 1.5 | 7.5 |

| | Al | Ti | Nb | Ta | Hf | Re |
|---|---|---|---|---|---|---|
| No. 61 150 kg ingot | 5.14 | 0.003 | 0.86 | 8.80 | 0.24 | 1.43 |
| U.S. Pat. No. 5,399,313 No. 49 | 4.2 | 3.5 | 0.5 | 4.7 | 0.15 | — |

TABLE 6

| | tempera- | stress | creep rupture properties | | | |
|---|---|---|---|---|---|---|
| No. | ture (° C.) | (kgf/mm$^2$) | life (h) | elon. (%) | R.A. (%) | P* |
| 1 | 850 | 45 | 977.5 | 13.1 | 22.7 | 25.82 |
| 2 | 850 | 40 | 2469.8 | 14.4 | 23.1 | 26.27 |
| 3 | 871 | 45 | 536.0 | 17.8 | 29.1 | 26.00 |
| 4 | 871 | 40 | 1031.7 | 15.4 | 28.4 | 26.33 |
| 5 | 927 | 35 | 195.0 | 18.7 | 35.2 | 26.75 |
| 6 | 927 | 32 | 273.5 | 15.7 | 33.2 | 26.92 |
| 7 | 927 | 32 | 334.0 | 8.4 | 9.4 | 27.03 |
| 8 | 927 | 32 | 404.2 | 22.7 | 29.1 | 27.13 |
| 9 | 927 | 25.3 | 1292.6 | 20.4 | 34.0 | 27.73 |
| 10 | 927 | 21 | 5104.7 | 19.8 | 34.2 | 28.45 |
| 11 | 982 | 21 | 480.0 | 17.2 | 36.9 | 28.46 |
| 12 | 982 | 17 | 1845.3 | 19.9 | 36.6 | 29.20 |
| 13 | 1040 | 17 | 143.3 | 27.2 | 36.8 | 29.09 |
| 14 | 1040 | 14 | 643.7 | 17 | 31.7 | 29.95 |

P*: Larson-Miller Parameter = temp. (K.) × (20 + log(life (h)) × $10^{-3}$

Figure 8:
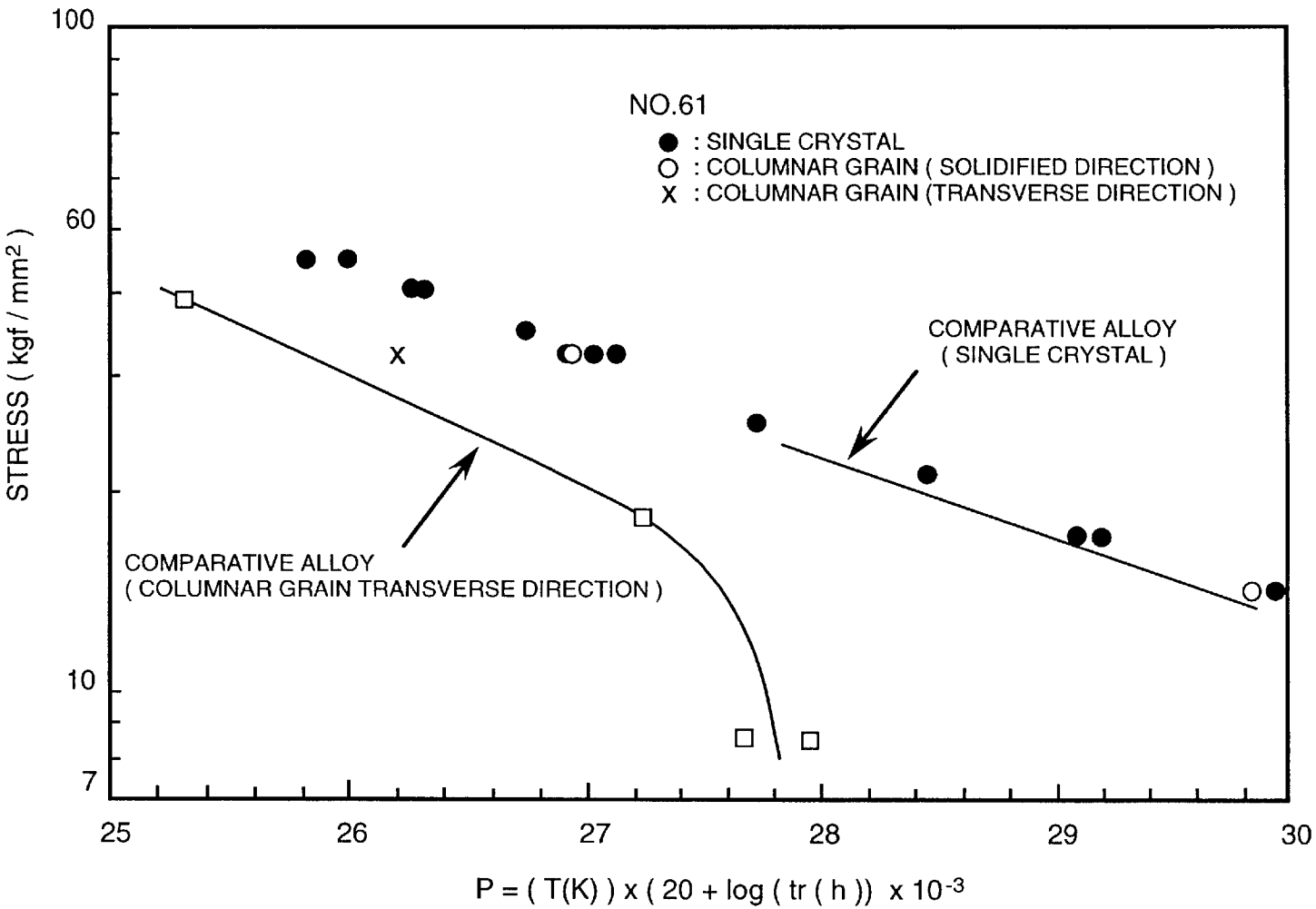
FIG. 8 shows the result obtained by normalizing the result shown in Table 6 with the Larson-Miller parameter.

The result obtained by normalizing the result shown in Table 6 by Larson-Miller parameter is shown in FIG. 8. For comparison, data of the single crystal alloy, which was improved in the strength at low angle boundaries, indicated in U.S. Pat. No. 5,399,313 are concurrently shown in FIG. 8. The strength of the single crystal of the comparative alloy was read from FIG. 7 of the reference, E. W. Ross and K. S. O'Hara, Rene 'N4: A first generation single crystal turbine airfoil alloy with improved oxidation resistance, low angle boundary strength and superior long time rupture strength Superalloys 1996, TMS, (1996), pb19–25, which corresponds to the No. 49 alloy, the alloy having the most superior characteristics, disclosed in U.S. Pat. No. 5,399,313. The data in the transverse direction of columnar grained castings of the comparative alloy were read from No. 49 alloy in Table 4 of U.S. Pat. No. 5,399,313.

On the basis of comparison of the strengths in the transverse direction of the columnar grained castings shown in FIG. 8, it is revealed that the strength of No. 61 sample of the present invention is significantly superior to the comparative alloy when grain boundaries exist. The strength of single crystal of the No. 61 sample is also superior to the comparative alloy. Furthermore, the strength in the solidified direction of the columnar grained casting of No. 61 sample is larger than the strength of single crystal of the comparative example. The reason of the larger strength of No. 61 sample of the present invention than the strength of the comparative alloy when the grain boundaries exist is in the additive amount of C and B, which are grain boundary strengthening elements, in No. 61 sample, which are larger than the comparative alloy. Especially, because the amount of B, which is the most effective for improving the strength of the grain boundaries, is remarkably large. Conventionally, when the additive amount of B is increased for improving the strength of the grain boundaries, the melting point of the alloy is decreased and complete solution heat treatment becomes impossible. However, the strength of the single crystal and the columnar grained castings in the solidified direction of No. 61 sample of the present invention is larger than the comparative example even if the complete solution heat treatment is not performed on the No. 61 sample. The reason for the above superior strength of No. 61 sample can be assumed to be based on effects of addition of Re, a large additive amount of Ta, and a low additive amount of Ti and Co. Especially, Ti which lowers the melting point of the alloy is substantially nil in No. 61 sample.

The alloy of the present invention can be used in a form of columnar grained castings. For instance, when single crystal buckets and/or stationary vanes are cast with the alloy of the present invention, the following advantages are achieved:

Difference in azimuth of orientation at grain boundaries of the alloy disclosed in U.S. Pat. No. 5,399,313 is substantially limited within 12°, however, the difference in azimuth of orientation at the grain boundaries of the alloy of the present invention can be allowed to the level of columnar grained castings wherein the difference in azimuth is substantially random. Therefore, especially, production yield and reliability of large size single crystal buckets or stationary vanes can be improved.

Further, it becomes possible to adjust an azimuth having a small elastic constant to a specified direction by casting with single crystal, and advantages to reduce thermal stress and to extend life of the buckets and the stationary vanes are realized. Furthermore, with the alloy having a superior strength at an elevated temperature even if the complete solution heat treatment is not performed such as the alloy of the present invention, it becomes possible to suppress growing re-crystallized grains, which grow significantly in the complete solution heat treatment, at the minimum. Accordingly, the problem of recrystalization, which lowers the strength of the recrystalized alloy to nearly zero, can be solved.

The advantage of the present invention is in a high strength Ni-base superalloy for directionally solidified casting being prevented from solidification cracking at casting, and having a sufficient grain boundary strength for ensuring reliability during operating period, and concurrently having a superior high temperature strength. In accordance with applying the alloy of the present invention to gas turbine members which are used at a high temperature, improvement of combustion temperature of the gas turbines and further improvement of power generating efficiency of power generating gas turbines can be realized.

What is claimed is:

1. A high strength Ni-base superalloy for directionally solidified castings consisting essentially of C: 0.06–0.08%, B: 0.018–0.035%, Hf: 0.02–0.3%, Cr: 6.9–7.3%, Mo: 0.7–1%, W: 8–9%, Re: 1.2–1.6%, Ta: 8.5–9.5%, Nb: 0.6–1%, Al: 4.9–5.2%, Co: 0.8–1.2%, and the balance being Ni and incidental impurities.

2. A high strength Ni-base superalloy as claimed in claim 1, wherein a creep rupture life in a solidified direction of said alloy is at least 350 hours under a condition of 1040° C., 14 kgf/mm$^2$, and the creep rupture life in a direction perpendicular to the solidified direction of said alloy is at least 30 hours under a condition of 927° C., 32 kgf/mm$^2$.

3. A directionally solidified casting composed of said Ni-base superalloy as claimed in claim 1, said casting has γ' phases in shapes of rectangular parallelepiped having an edge equal to or less than 0.5 μm in a region at least 50% in volumetric fraction formed by a solution heat treatment, a creep rupture life in a direction perpendicular to a solidified direction of at least 30 hours under a condition at 927° C., 32 kgf/mm$^2$, and a tensile strength in the solidified direction of at least 95 kgf/mm$^2$ at 800° C.

4. A high strength Ni-base superalloy for directionally solidified castings as claimed in claim 1, wherein said Ni-base superalloy is single crystals.

5. A high strength Ni-base superalloy for directionally solidified castings consisting essentially of C: 0.06–0.08%, B: 0.018–0.035%, Hf: 0.2–0.3%, Cr: 6.9–7.3%, Mo: 0.7–1%, W: 8–9%, Re: 1.2–1.6%, Ta: 8.5–9.5%, Nb: 0.3–1%, Al: 4.9–5.2%, Co: 0.8–1.2%, and the balance being Ni and incidental impurities.

6. A high strength Ni-base superalloy as claimed in claim 5, wherein a creep rupture life in a solidified direction of said alloy is at least 350 hours under a condition of 1040° C., 14 kgf/mm$^2$, and the creep rupture life in a direction perpendicular to the solidified direction of said alloy is at least 30 hours under a condition of 927° C., 32 kgf/mm$^2$.

7. A directionally solidified casting composed of said Ni-base superalloy as claimed in claim 5, said casting has γ' phases in shapes of rectangular parallelepiped having an edge equal to or less than 0.5 μm in a region at least 50% in volumetric fraction formed by a solution heat treatment, a creep rupture life in a direction perpendicular to a solidified direction of at least 30 hours under a condition at 927° C., 32 kgf/mm$^2$, and a tensile strength in the solidified direction of at least 95 kgf/mm$^2$ at 800° C.

8. A high strength Ni-base superalloy for directionally solidified castings as claimed in claim 5, wherein said Ni-base superalloy is single crystals.

9. A high strength Ni-base superalloy for directionally solidified castings consisting essentially of C: 0.06–0.15%, B: 0.004–0.05%, Hf: 0.01–1.0%, Zr: equal to or less than 0.02%, Cr: 6.5–8.5%, Mo: equal to or less than 4.5%, W: 5–10%, Re: 0.5–7%, Ta: 5–12%, Nb: equal to or less than 4.0%, Al: 4.0–6.5%, Co: equal to or less than 2.5%, and the balance being Ni and incidental impurities.

10. A high strength Ni-base superalloy as claimed in claim 9, wherein a creep rupture life in a solidified direction of said alloy is at least 350 hours under a condition of 1040° C., 14 kgf/mm$^2$, and the creep rupture life in a direction perpendicular to the solidified direction of said alloy is at least 30 hours under a condition of 927° C., 32 kgf/mm$^2$.

11. A directionally solidified casting composed of said Ni-base superalloy as claimed in claim 9, said casting has γ' phases in shapes of rectangular parallelepiped having an edge equal to or less than 0.5 μm in a region at least 50% in volumetric fraction formed by a solution heat treatment, a creep rupture life in a direction perpendicular to a solidified direction of at least 30 hours under a condition at 927° C., 32 kgf/mm$^2$, and a tensile strength in the solidified direction of at least 95 kgf/mm$^2$ at 800° C.

12. A high strength Ni-base superalloy for directionally solidified castings as claimed in claim 9, wherein said Ni-base superalloy is single crystals.

13. A high strength Ni-base superalloy for directionally solidified castings consisting essentially of C: 0.06–0.08%, B: 0.016–0.035%, Hf: 0.2–0.3%, Cr: 6.9–7.3%, Mo: 0.7–1.0%, W: 8.0–9.0%, Re: 1.2–1.6%, Ta: 8.5–9.5%, Nb: 0.6–1.0%, Al: 4.9–5.2%, Co: 0.8–1.2%, and the balance being Ni and incidental impurities.

14. A high strength Ni-base superalloy as claimed in claim 13, wherein a creep rupture life in a solidified direction of said alloy is at least 350 hours under a condition of 1040° C., 14 kgf/mm$^2$, and the creep rupture life in a direction perpendicular to the solidified direction of said alloy is at least 30 hours under a condition of 927° C., 32 kgf/mm$^2$.

15. A directionally solidified casting composed of said Ni-base superalloy as claimed in claim 13, said casting has γ' phases in shapes of rectangular parallelepiped having an edge equal to or less than 0.5 μm in a region at least 50% in volumetric fraction formed by a solution heat treatment, a creep rupture life in a direction perpendicular to a solidified direction of at least 30 hours under a condition at 927° C., 32 kgf/mm$^2$, and a tensile strength in the solidified direction of at least 95 kgf/mm$^2$ at 800° C.

16. A high strength Ni-base superalloy for directionally solidified castings as claimed in claim 13, wherein said Ni-base superalloy is single crystals.

17. A high strength Ni-base superalloy for directionally solidified castings consisting essentially of C: 0.06–0.10%, B: 0.004–0.05%, Hf: 0.01–1.0%, Zr: equal to or less than 0.02%, Cr: 6.5–8.5%, Mo: 0.4–1.8%, W: 5–10%, Re: 1–9%, Ta: 5–12%, Nb: 0.3–3.0%, Al: 4.0–6.5%, Ti: less than 0.4%, Co: 0.5–2.5%, and the balance being Ni and incidental impurities.

18. A high strength Ni-base superalloy for directionally solidified castings consisting essentially of C: 0.06–0.09%, B: 0.018–0.04%, Hf: 0.01–less than 0.5%, Zr: less than 0.01%, Cr: 6.5–8.5%, Mo: 0.4–1.8%, W: 5–10%, Re: 1–6%, Ta: 5–12%, Nb: equal to or less than 1.71%, Ti: less than 0.4%, Al: 4.7–5.7%, Co: 0.5–1.2%, and the balance being Ni and incidental impurities.

19. A high strength Ni-base superalloy for directionally solidified castings consisting essentially of C: 0.06–0.09%, B: 0.018–0.035%, Hf: 0.2–0.4%, Cr: 6.5–8.5%, Mo: 0.4–1%, W: 5.5–9.5%, Re: 1.2–3.1%, Ta: 8–10%, Nb: 0.3–1%, Al: 4.7–5.4%, Co: 0.8–1.2%, Ti: less than 0.4%, and the balance being Ni and incidental impurities.

20. A high strength Ni-base superalloy for directionally solidified castings consisting essentially of C: 0.06–0.08%, B: 0.018–0.035%, Hf: 0.2–0.3%, Cr: 6.9–7.3%, Mo: 0.7–1%, W: 8–9%, Re: 1.2–1.6%, Ta: 8.5–9.5%, Nb: 0.6–1%, Al: 4.9–5.2%, Co: 0.8–1.2%, Ti: less than 0.4%, and the balance being Ni and incidental impurities.

21. A high strength Ni-base superalloy for directionally solidified castings consisting essentially of C: 0.06–0.10%, B: 0.004–0.05%, Cr: 6.5–8.5%, Mo: 0.4–1.8%, W: 5.0–10.0%, Re: 1.0–7.0%, Ta: 5.0–12.0%, Nb: 0.3–4.0%, Al: 4.0–6.5%, Ti: less than 0.4%, Co: 0.5–2.5%, Hf: 0.01–1.0%, Zr: equal to or less than 0.015%, and the balance being Ni and incidental impurities.

22. A high strength Ni-base superalloy for directionally solidified castings consisting essentially of C: 0.06–0.10%, B: 0.018–0.04%, Hf: 0.01–less than 0.5%, Cr: 6.5–8.5%, Mo: 0.4–1.8%, W: 5.5–9.5%, Re: 1.0–6.0%, Ta: 6–10.5%, Nb: 0.3–1.55%, Al: 4.0–6.5%, Co: 0.5–2.5%, Ti: less than 0.4%, and the balance being Ni and incidental impurities.

23. A high strength Ni-base superalloy for directionally solidified castings consisting essentially of C: 0.06–0.10%, B: 0.018–0.025%, Hf: 0.2–0.3%, Cr: 6.9–7.3%, Mo: 0.7–1%, W: 7.0–9.0%, Re: 1.2–2.0%, Ta: 8.5–9.5%, Nb: 0.6–1.0%, Al: 4.0–6.0%, Co: 0.5–1.2% and the balance being Ni and incidental impurities.

24. A high strength Ni-base superalloy for directionally solidified castings consisting essentially of C: 0.06–0.09%, B: 0.016–0.04%, Hf: 0.01–less than 0.5%, Zr: less than 0.01%, Cr: 6.5–8.5%, Mo: 0.4–1.8%, W: 5–10%, Re: 1–6% Ta: 5–12%, Nb: 0.3–3.0%, Ti: less than 0.4%, Al: 4.7–5.7%, Co: 0.5–2.5%, and the balance being Ni and incidental impurities.

25. A high strength Ni-base superalloy for directionally solidified castings consisting essentially of C: 0.06–0.09%, B: 0.016–0.035%, Hf: 0.2–0.4%, Cr: 6.5–8.5%, Mo: 0.4–1.0%, W: 5.5–9.5%, Re: 1.2–3.1%, Ta: 8–10%, Nb: 0.3–1.0%, Al: 4.7–5.4%, Co: 0.8–1.2%, Ti: less than 0.4%, and the balance being Ni and incidental impurities.

* * * * *